US009704428B2

(12) United States Patent
Mori et al.

(10) Patent No.: US 9,704,428 B2
(45) Date of Patent: Jul. 11, 2017

(54) DISPLAY DEVICE AND DISPLAY METHOD

(71) Applicant: Sharp Kabushiki Kaisha, Osaka-shi, Osaka (JP)

(72) Inventors: Tomohiko Mori, Osaka (JP); Kazunari Tomizawa, Osaka (JP); Makoto Hasegawa, Osaka (JP); Yuichi Yoshida, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 129 days.

(21) Appl. No.: 14/411,003

(22) PCT Filed: Jun. 7, 2013

(86) PCT No.: PCT/JP2013/065791

§ 371 (c)(1),
(2) Date: Dec. 23, 2014

(87) PCT Pub. No.: WO2014/007024

PCT Pub. Date: Jan. 9, 2014

(65) Prior Publication Data

US 2015/0325165 A1 Nov. 12, 2015

(30) Foreign Application Priority Data

Jul. 6, 2012 (JP) ..... 2012-153105

(51) Int. Cl.
*G09G 3/20* (2006.01)
*G09G 3/36* (2006.01)

(52) U.S. Cl.
CPC ..... *G09G 3/2081* (2013.01); *G09G 3/2025* (2013.01); *G09G 3/2074* (2013.01); (Continued)

(58) Field of Classification Search
CPC ..... G09G 3/2081; G09G 3/20; G09G 3/36; G09G 3/2074; G09G 3/2025; (Continued)

(56) References Cited

U.S. PATENT DOCUMENTS

2005/0184944 A1* 8/2005 Miyata ..... G09G 3/3611 345/89
2008/0024409 A1* 1/2008 Tomizawa ..... G09G 3/3648 345/88

(Continued)

FOREIGN PATENT DOCUMENTS

JP 2008224798 A 9/2008
WO WO-2006098448 A1 9/2006
WO WO-2010102181 A1 9/2010

*Primary Examiner* — Temesghen Ghebretinsae
*Assistant Examiner* — Ivelisse Martinez Quiles
(74) *Attorney, Agent, or Firm* — Harness, Dickey & Pierce P.L.C.

(57) ABSTRACT

A display device is disclosed, along with a display method capable of displaying an input image having a resolution higher than the resolution of a display panel without degradation in display quality. The display device is a display device for displaying an image with each frame divided into two sub-frames. In the display device, a bright sub-pixel and a dark sub-pixel in each pixel are interchanged every sub-frame, and an input signal has a vertical resolution twice that of a display panel. The display device displays an image corresponding to the input signal by making the sub-frames different from each other in a voltage supplied to each pixel.

10 Claims, 30 Drawing Sheets

(52) U.S. Cl.
CPC ..... *G09G 3/2077* (2013.01); *G09G 3/3614* (2013.01); *G09G 3/3648* (2013.01); *G09G 3/3655* (2013.01); *G09G 2300/0452* (2013.01); *G09G 2300/0465* (2013.01); *G09G 2300/0876* (2013.01); *G09G 2320/028* (2013.01); *G09G 2320/0276* (2013.01)

(58) Field of Classification Search
CPC .. G09G 3/3648; G09G 3/3655; G09G 3/3614; G09G 3/2077; G09G 2300/0876; G09G 2320/0276; G09G 2300/0465; G09G 2320/028; G09G 2300/0452
See application file for complete search history.

(56) References Cited

U.S. PATENT DOCUMENTS

2008/0036953 A1* 2/2008 Otake ..... G02F 1/133555 349/114
2008/0106657 A1 5/2008 Kitayama et al.
2008/0218500 A1 9/2008 Akai et al.
2009/0002585 A1* 1/2009 Shimoshikiryoh .. G09G 3/3614 349/39
2009/0195487 A1* 8/2009 Shimoshikiryoh .. G09G 3/3614 345/89
2009/0268110 A1* 10/2009 Kitayama ..... G09G 3/3614 349/37
2010/0026728 A1* 2/2010 Miyazaki ..... G09G 3/36 345/690
2010/0149227 A1* 6/2010 Tomizawa ..... G09G 3/3648 345/694
2010/0225679 A1* 9/2010 Guncer ..... G09G 3/2022 345/690
2010/0289975 A1* 11/2010 Nakagawa ..... G02F 1/133707 349/33
2011/0170014 A1* 7/2011 Irie ..... G09G 3/3614 348/731
2011/0221970 A1* 9/2011 Kawabata ..... G09G 3/3614 348/731
2011/0221972 A1* 9/2011 Kawabata ..... G09G 3/3666 348/731
2011/0254759 A1* 10/2011 Mori ..... G09G 3/3607 345/88
2011/0254879 A1* 10/2011 Mori ..... G09G 3/3607 345/690

* cited by examiner

FIG. 1 q=1 TO cq p=1 TO rp

| | | FIRST COLUMN S-C1 | SECOND COLUMN S-C2 | THIRD COLUMN S-C3 | FOURTH COLUMN S-C4 | FIFTH COLUMN S-C5 | SIXTH COLUMN S-C6 | |
|---|---|---|---|---|---|---|---|---|
| | CS-A | A+H | A−L | A+H | A−L | A+H | A−L | SPa(1, 6) |
| FIRST ROW | G-L1 | L+B | H−B | L+B | H−B | L+B | H−B | SPb(1, 6) |
| | CS-B | B−H | B+L | B−H | B+L | B−H | B+L | |
| SECOND ROW | G-L2 | L−A | H+A | L−A | H+A | L−A | H+A | |
| | CS-A | A+H | A−L | A+H | A−L | A+H | A−L | |
| THIRD ROW | G-L3 | L+B | H−B | L+B | H−B | L+B | H−B | SPa(p, q) / SPb(p, q) |
| | CS-B | B−H | B+L | B−H | B+L | B−H | B+L | |
| FOURTH ROW | G-L4 | L−A | H+A | L−A | H+A | L−A | H+A | |
| | CS-A | A+H | A−L | A+H | A−L | A+H | A−L | |
| FIFTH ROW | G-L5 | L+B | H−B | L+B | H−B | L+B | H−B | |
| | CS-B | B−H | B+L | B−H | B+L | B−H | B+L | |
| SIXTH ROW | G-L6 | L−A | H+A | L−A | H+A | L−A | H+A | |
| | CS-A | A+H | A−L | A+H | A−L | A+H | A−L | |
| SEVENTH ROW | G-L7 | L+B | H−B | L+B | H−B | L+B | H−B | |
| | CS-B | B−H | B+L | B−H | B+L | B−H | B+L | |
| EIGHTH ROW | G-L8 | L−A | H+A | L−A | H+A | L−A | H+A | |
| | CS-A | | | | | | | |

P(1, 6)

P(p, q)

FIG. 34
(a)
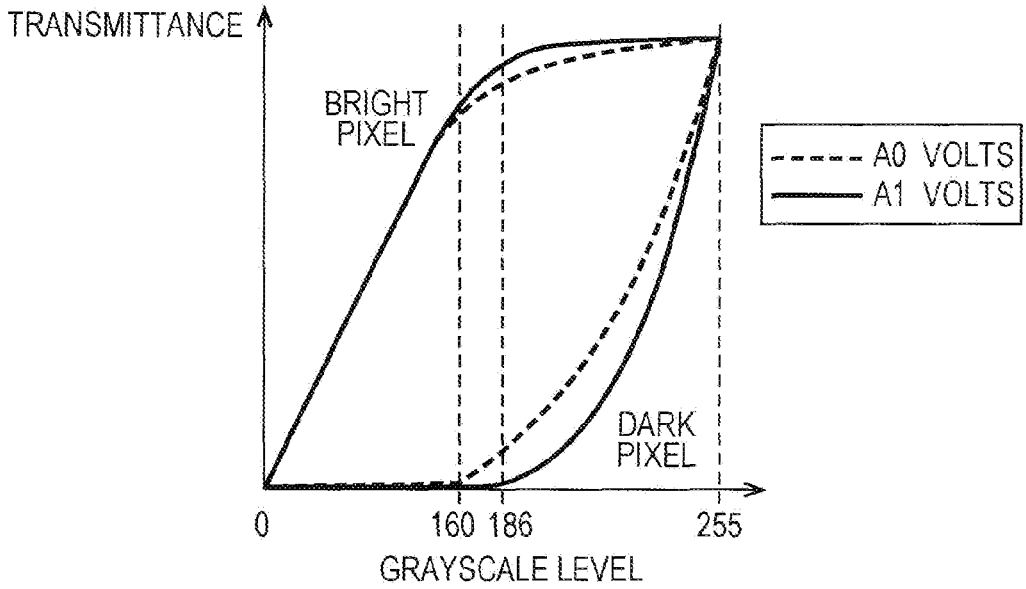
(b)
CS VOLTAGE OF A0 VOLTS (FOR IMPROVEMENT OF VIEWING ANGLE)
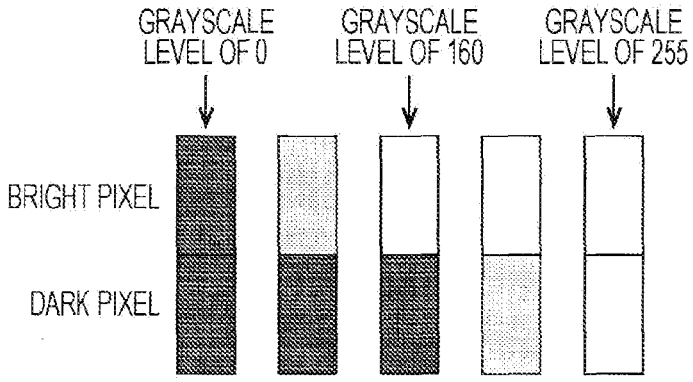
(c)
CS VOLTAGE OF A1 VOLTS (FOR INCREASE OF RESOLUTION)
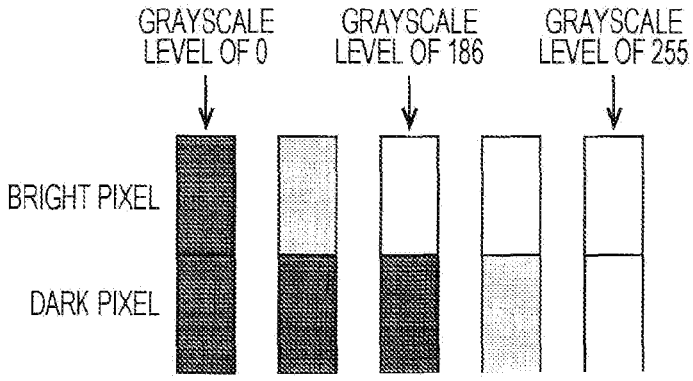

DISPLAY DEVICE AND DISPLAY METHOD

TECHNICAL FIELD

The present invention relates to a display device for displaying input image data having a resolution different from that of a display panel.

BACKGROUND ART

If input image data has a resolution different from that of a display panel in a conventional display device, the conventional display device displays the input image on an enlarged or reduced scale (for example, PTL 1). Namely, if the number of pixels of the input image is different from the total number of pixels of the display panel, the display panel displays the image with a number of pixels different from the number of pixels of the input image.

Known techniques for enlarging or reducing an input image include a bilinear technique and a bicubic technique. According to these techniques, pixels which are not present in an input image are interpolated by performing averaging or weighted averaging of the values of surrounding pixels, or pixels of an input image are decimated by a computation, such as filter processing. With this process, an output value corresponding to each pixel of the display panel is obtained, and a display is produced.

CITATION LIST

Patent Literature

PTL 1: Japanese Unexamined Patent Application Publication No. 2008-224798

SUMMARY OF INVENTION

Technical Problem

However, when an input image is enlarged or reduced by a conventional technique, information on profiles, colors, and the like included in original input image data cannot be completely reproduced. For example, when an input image is reduced, the number of pixels is decreased in accordance with the resolution on the output side (the total number of pixels of the display panel). As a result, color blurring or the like occurs, which causes degradation in image quality.

In general, at the time of reduction processing, an input signal is processed with a low-pass filter (LPF) and then is subjected to sampling processing in accordance with the resolution on the output side (on the display panel side). The LPF is designed so as to have a cut-off characteristic with ½ of the maximum value of a frequency at which a display can be produced on the output side in mind. Due to the cut-off characteristic of the LPF, a reduced image is blurred or deformed. Such as blur or deformation is based on principle and cannot be avoided by any conventional technique.

The present invention has been made in light of the above-described problem and has as its object to provide a display device and a display method capable of displaying an input image having a resolution higher than that of a display panel without degradation in display quality.

Solution to Problem

In order to solve the above-described problem, a display device according to the present invention is a display device for displaying an image with each frame divided into m sub-frames, m being an integer not less than 2, wherein each of pixels in a display unit has a first sub-pixel and a second sub-pixel different in luminance from each other, the first sub-pixel and the second sub-pixel in each pixel each switch between display of a high-luminance image and display of a low-luminance image for every one of the sub-frames, an input signal input from an outside to the display device has a vertical resolution different from a vertical resolution of a display panel, and the display device displays an image corresponding to the input signal by making the sub-frames different from each other in a voltage to be supplied to each pixel.

According to the above-described configuration, the display device performs so-called frame division driving and pixel division driving. In the above-described display device, the bright/dark display status of each of the first sub-pixel and the second sub-pixel in each pixel switches from one to the other every sub-frame, and the sub-frames are different from each other in a voltage supplied to each pixel. This allows the first sub-pixel and the second sub-pixel to be independently controlled in luminance. For this reason, for example, if one pixel is composed of two sub-pixels, and a display is produced with each frame divided into two sub-frames, an input signal having a longitudinal resolution twice a longitudinal resolution of a display panel can be displayed.

Thus, the above-described display device can display an input image having a resolution higher than the resolution of the display panel without degradation in display quality.

In the display device according to the present invention, it is preferable that the display device include a control unit which outputs display signals in first to m-th ones of the sub-frames to the display unit, that the first sub-pixel and the second sub-pixel be connected to a single data signal line and a single scanning signal line and be connected to storage capacitor lines different from each other, and that the control unit produce a luminance difference between the first sub-pixel and the second sub-pixel by level-shifting a storage capacitor line signal which is supplied to the storage capacitor line corresponding to the first sub-pixel and a storage capacitor line signal which is supplied to the storage capacitor line corresponding to the second sub-pixel in directions different from each other and changing the level-shift direction for each of the storage capacitor line signals within the frame, and inverting a voltage polarity of a display signal every frame cycle and making the sub-frames different from each other in a voltage of the display signal.

According to the above-described configuration, a bright sub-pixel and a dark sub-pixel can be formed in each pixel by shifting the voltage level of a storage capacitor line signal supplied to each storage capacitor line.

In the display device according to the present invention, it is preferable that each frame be divided into two sub-frames, that the first sub-pixels and the second sub-pixels be each arranged in a row direction and be alternately arranged in a column direction, and that the vertical resolution of the input signal be twice the vertical resolution of the display panel.

This configuration allows display of a high-resolution image (1920 wide by 2160 high) in a FHD (1920 wide by 1080 high) liquid crystal panel.

In the display device according to the present invention, it is preferable that, if each frame is divided into two sub-frames, the sub-frames within the frame be different from each other in the level-shift direction for the storage capacitor line signal given to each of the storage capacitor lines, and a last one of the sub-frames of the frame and a first one of sub-frames of a succeeding frame be equal to each other in the level-shift direction for the storage capacitor line signal given to the storage capacitor line.

In the display device according to the present invention, it is preferable that only the first sub-pixel be lighted for grayscale levels between not lower than one at which luminance of a display signal is a minimum and lower than one at which luminance is 0.5, and that the first sub-pixel and the second sub-pixel be lighted for the grayscale level, at which luminance of a display signal is 0.5, or a higher grayscale level.

In the display device according to the present invention, it is preferable that, if the display unit displays a grayscale level of 0 to a grayscale level of 255, the grayscale level, at which luminance is 0.5, be a grayscale level of 186.

In the display device according to the present invention, it is preferable that the storage capacitor line signal given to each of the storage capacitor lines be not level-shifted during writing of a signal voltage to a pixel electrode which, together with the storage capacitor line, forms a capacitor and be level-shifted in a positive direction or a negative direction with respect to a reference voltage in synchronization with or after an end of the writing.

In the display device according to the present invention, it is preferable that one of the storage capacitor lines which, together with one of two included in each pixel of the pixel electrodes, forms a capacitor and one of the storage capacitor lines which, together with the other, forms a capacitor be opposite to each other in storage capacitor line signal level-shift direction.

The display device according to the present invention can also be configured such that one of the pixel electrodes which is included in one of two adjacent in a scanning direction of the pixels and one of the pixel electrodes which is included in the other each form a capacitor together with a single one of the storage capacitor lines.

The display device according to the present invention can also be configured such that each of the pixels is composed of four types of color pixels displaying colors different from each other, and such that each of the four types of color pixels includes the first sub-pixel and the second sub-pixel.

This configuration allows widening of a color reproduction range.

The display device according to the present invention can also be configured such that the four types of color pixels are a red pixel displaying red, a green pixel displaying green, a blue pixel displaying blue, and a yellow pixel displaying yellow, and the color pixels in this order are repeatedly arranged in a row direction.

This configuration allows improvement of a visual resolution in a horizontal direction.

In order to solve the above-described problem, a display method according to the present invention is a display method for displaying an image with each frame divided into m sub-frames, m being an integer not less than 2, wherein each of pixels in a display unit has a first sub-pixel and a second sub-pixel different in luminance from each other, the first sub-pixel and the second sub-pixel in each pixel each switch between display of a high-luminance image and display of a low-luminance image for every one of the sub-frames, an input signal input from an outside to the display device has a vertical resolution different from a vertical resolution of a display panel, and an image corresponding to the input signal is displayed by making the sub-frames different from each other in a voltage to be supplied to each pixel.

In the display method according to the present invention, it is preferable that the display method include an output step of outputting display signals in first to m-th ones of the sub-frames to the display unit, that the first sub-pixel and the second sub-pixel be connected to a single data signal line and a single scanning signal line and be connected to storage capacitor lines different from each other, and that the output step include producing a luminance difference between the first sub-pixel and the second sub-pixel by level-shifting a storage capacitor line signal which is supplied to the storage capacitor line corresponding to the first sub-pixel and a storage capacitor line signal which is supplied to the storage capacitor line corresponding to the second sub-pixel in directions different from each other and changing the level-shift direction for each of the storage capacitor line signals within the frame, and inverting a voltage polarity of a display signal every frame cycle and making the sub-frames different from each other in a voltage of the display signal.

In the display method according to the present invention, it is preferable that each frame be divided into two sub-frames, that the first sub-pixels and the second sub-pixels be each arranged in a row direction and be alternately arranged in a column direction, and that the vertical resolution of the input signal be twice the vertical resolution of the display panel.

The above-described display methods can obtain the same effects as the above-described display devices.

Advantageous Effects of Invention

In the display device and the display method according to the present invention, the first sub-pixel and the second sub-pixel in each pixel each switches between display of a high-luminance image and display of a low-luminance image for every one of the sub-frames. The display device or the display method displays an image corresponding to the input signal by making the sub-frames different from each other in a voltage supplied to each pixel. This allows the first sub-pixel and the second sub-pixel to be independently controlled in luminance. The above-described display device can display an input image having a resolution higher than the resolution of the display panel without degradation in display quality.

BRIEF DESCRIPTION OF DRAWINGS

FIG. 1 is a plan view schematically showing a pixel array of a liquid crystal display device according to a first embodiment.

FIGS. 34(*a*) to (*c*) are graphs showing the relation between a grayscale level and the transmittance of each sub-pixel (SP1 or SP2) depending on a CS voltage.

DESCRIPTION OF EMBODIMENTS

One embodiment of the present invention will be described with reference to the drawings. A liquid crystal display device (display device) according to the present embodiment produces a display with each frame divided into a plurality of (for example, two) sub-frames (frame division driving) and produces a display with the luminances of a plurality of (for example, two) sub-pixels included in one pixel different from each other (pixel division driving or multi-pixel driving).

First Embodiment (Pixel Division Driving)

A specific configuration of pixel division driving in a liquid crystal display device according to the present embodiment will be described first. Note that the configuration described in, for example, "WO 2006/098449" can be applied to the pixel division driving.

A liquid crystal display device shown in FIG. 1 has pixels arranged in a matrix (rp by cq) with a plurality of rows (1 to rp) and a plurality of columns (1 to cq). Each pixel P(p,q) (where 1≤p≤rp and 1≤q≤cq) has two sub-pixels SPa(p,q) and SPb(p,q). FIG. 1 schematically shows a part (eight rows by six columns) of the relative layout of source lines (data signal lines) S-C1, S-C2, S-C3, S-C4, . . . , S-Ccq, gate lines (scanning signal lines) G-L1, G-L2, G-L3, . . . , G-Lrp, CS lines (storage capacitor lines) CS-A and CS-B, the individual pixels P(p,q), and the sub-pixels SPa(p,q) and SPb (p,q) constituting each pixel.

As shown in FIG. 1, one pixel P(p,q) has sub-pixels SPa(p,q) and SPb(p,q) above and under a gate line G-Lp which extends horizontally near a center of the pixel. That is, the sub-pixels SPa(p,q) and SPb(p,q) are arranged in a column direction in each pixel. One of respective storage capacitor electrodes (not shown) of the sub-pixels SPa(p,q) and SPb(p,q) is connected to an adjacent CS line CS-A or CS-B. A source line S-Cq to supply a display signal (also referred to as a "display signal voltage" or a "source signal voltage") corresponding to a display image to each pixel P(p,q) is provided so as to extend vertically (in the column direction) between pixels to supply signal voltages to respective TFT elements (not shown) of sub-pixels (pixels) on the right-hand side of the source line. The configuration shown in FIG. 1 is a configuration in which one CS line or one gate line is shared by two sub-pixels and has an advantage in its capability of increasing the aperture ratio of each pixel.

Figure 2:
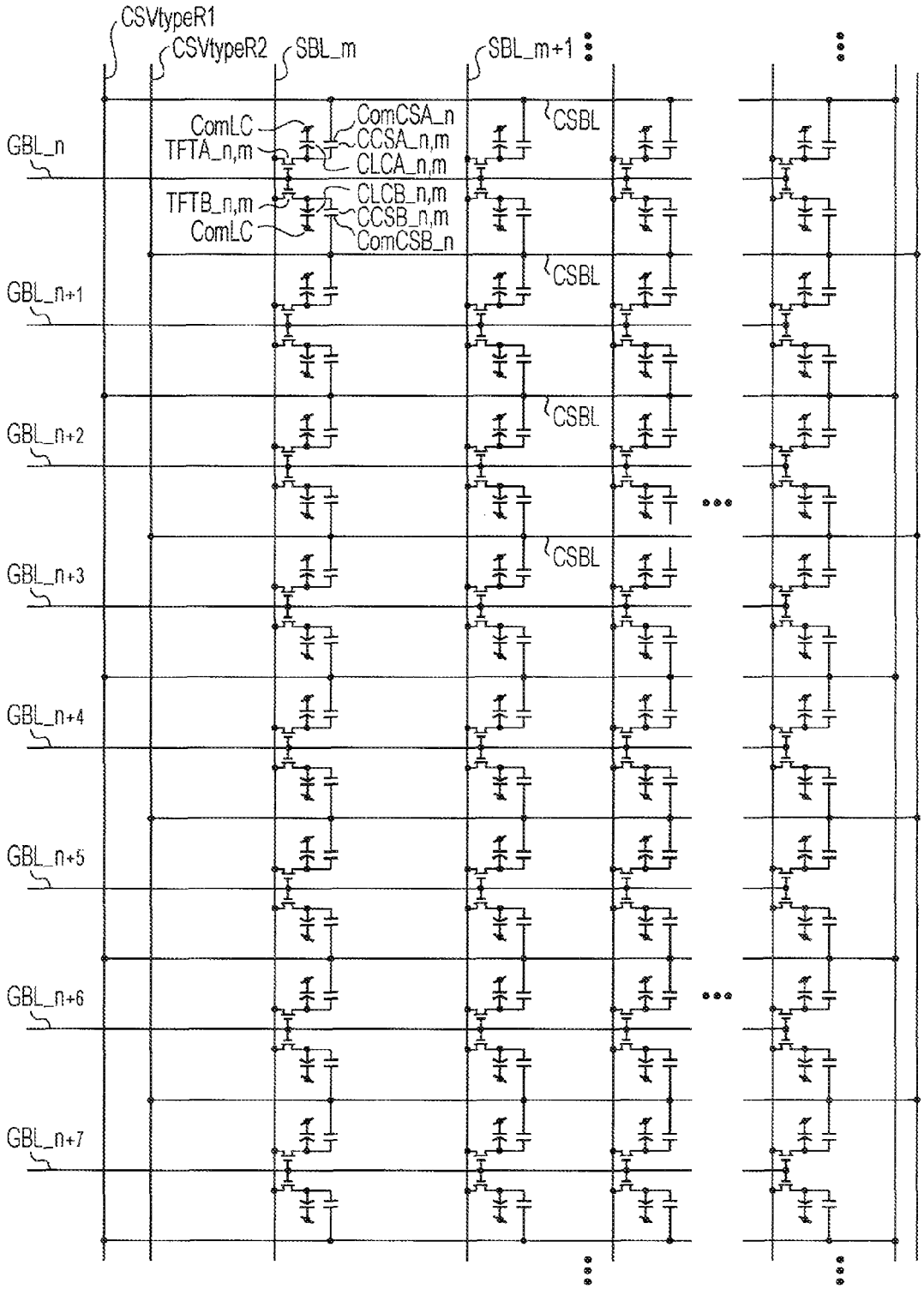
FIG. 2 is an equivalent circuit diagram of a region as a part of the liquid crystal display device according to the first embodiment.

FIG. 2 is an equivalent circuit diagram of a given region of the liquid crystal display device having the pixel array shown in FIG. 1. The liquid crystal display device has pixels arranged in a matrix with rows and columns, and each pixel has two sub-pixels. The sub-pixels (the symbols A and B denote the two sub-pixels) have liquid crystal capacitors CLCA_n,m and CLCB_n,m and storage capacitors CCSA_n,m and CCSB_n,m.

Each liquid crystal capacitor is composed of a sub-pixel electrode, a counter electrode ComLC, and a liquid crystal layer provided between the electrodes. Each storage capacitor is composed of a storage capacitor electrode, an insulating film, and a storage capacitor counter electrode (ComCSA_n or ComCSB_n). The two sub-pixels are connected to a common source line SBL_m via a corresponding TFTA_n,m and a corresponding TFTB_n,m, respectively. On-off control of the TFTA_n,m and the TFTB_n,m is performed by a scanning signal voltage supplied to a common gate line GBL_n. When the two TFTs are ON, a display signal voltage is supplied from the common source line to the sub-pixel electrode and the storage capacitor electrode of each of the two sub-pixels. The storage capacitor counter electrode of one of the two sub-pixels is connected to a storage capacitor trunk line (CS trunk line) CSVtypeR1 via a CS line (CSBL) while the storage capacitor counter electrode of the other is connected to a storage capacitor trunk line (CS trunk line) CSVtypeR2.

A point to note in FIG. 2 is that CS lines corresponding to sub-pixels of pixels in rows adjacent in the column direction are electrically the same as each other. Specifically, a CS line CSBL corresponding to the sub-pixel CLCB_n,m in an n-th line and a CS line CSBL corresponding to a sub-pixel CLCA_n+1,m in a row adjacent in the column direction are electrically the same.

Figure 3:
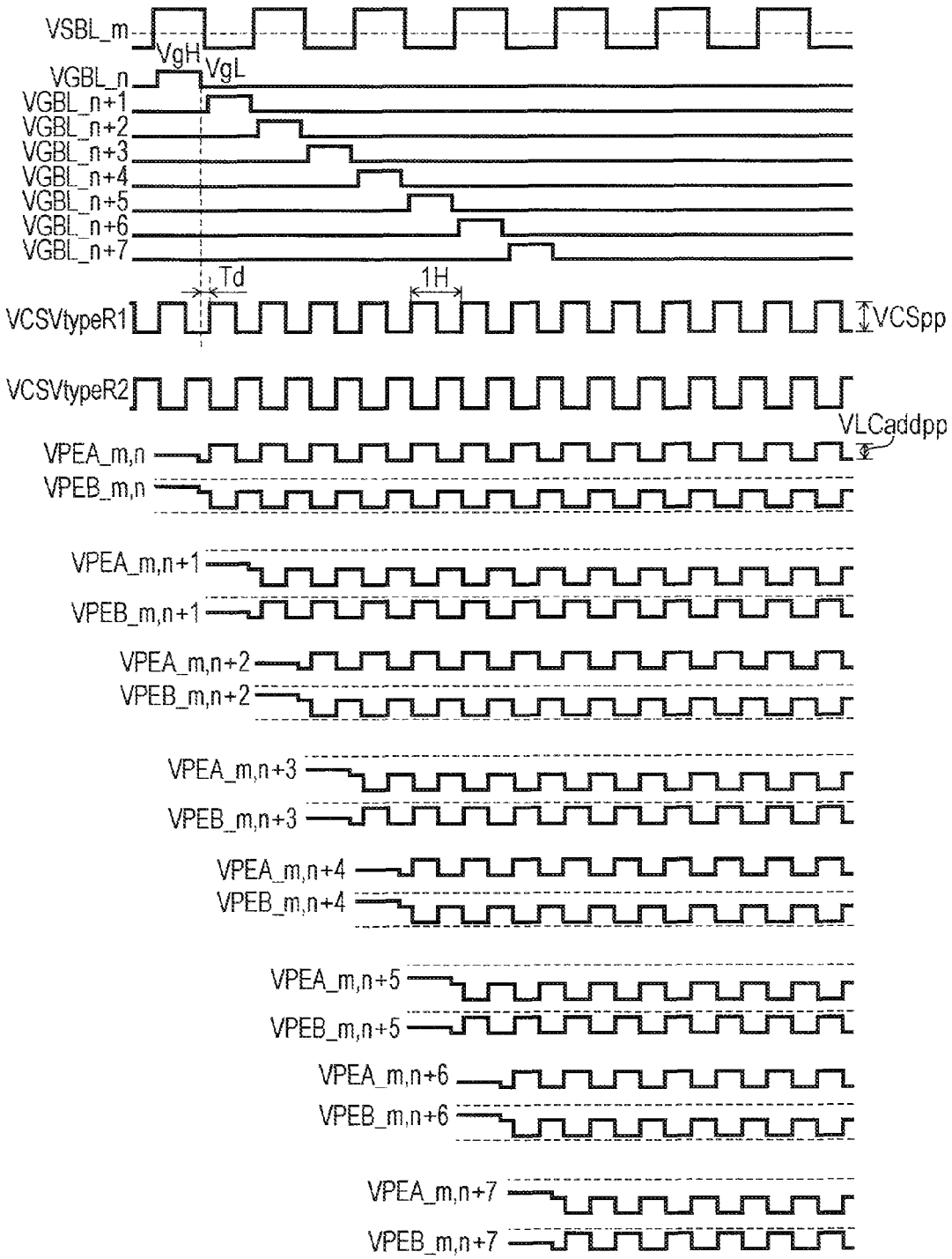
FIG. 3 is a chart showing the periods and phases of CS voltages supplied to CS lines with respect to the voltage waveforms of gate lines and the voltages of individual sub-pixel electrodes in the liquid crystal display device according to the first embodiment.
Figure 4:
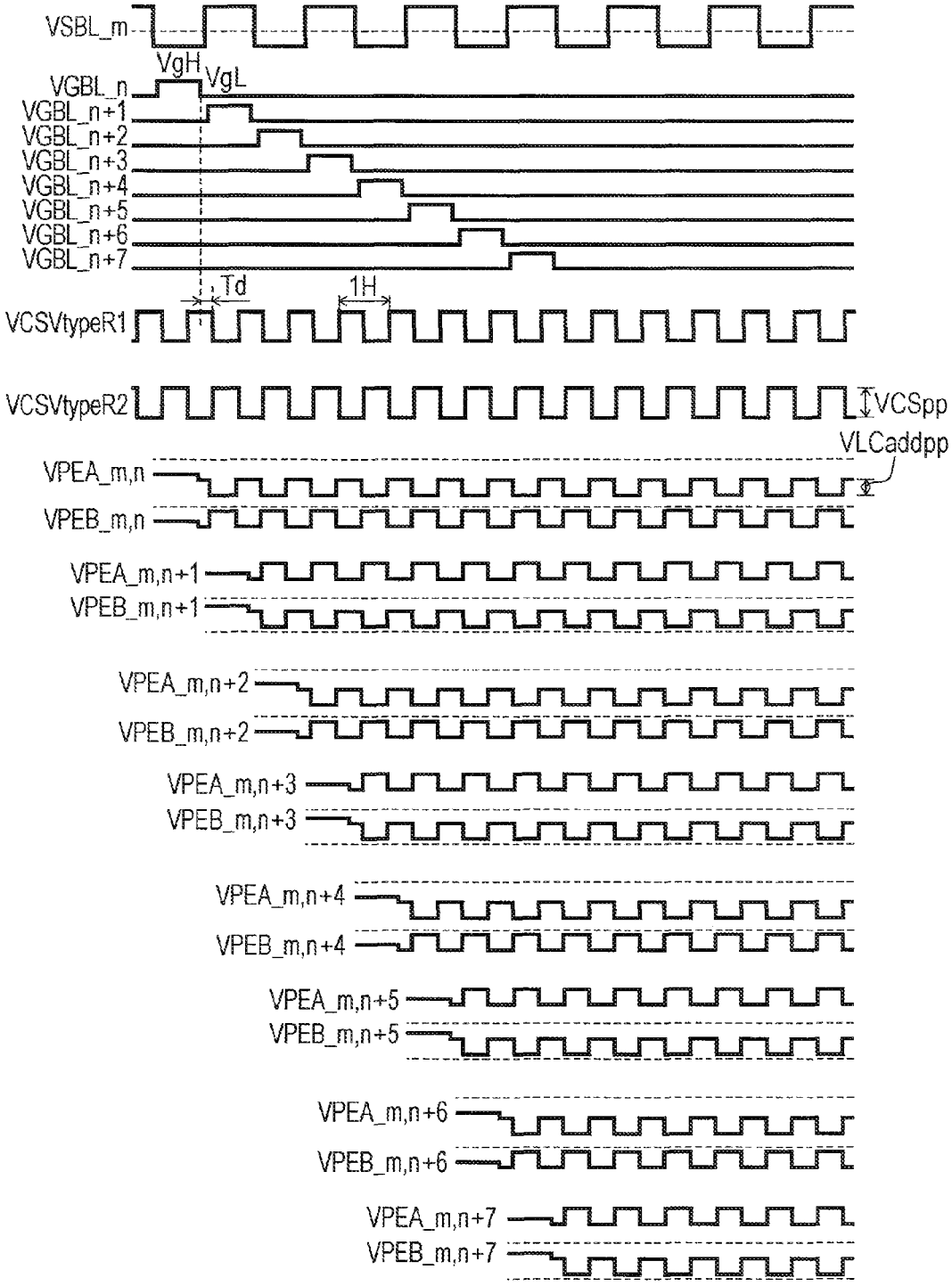
FIG. 4 is a chart showing the periods and phases of the CS voltages supplied to the CS lines with respect to the voltage waveforms of the gate lines and the voltages of the individual sub-pixel electrodes in the liquid crystal display device according to the first embodiment.

FIGS. 3 and 4 show the periods and phases of CS voltages supplied to CS lines (CS signals) with respect to the voltage waveforms of gate lines, and the voltages of sub-pixel electrodes. In a general liquid crystal display device, the direction of an electric field applied to a liquid crystal layer of each pixel is inverted at regular time intervals (for example, every vertical scanning period), and two types of drive voltage waveforms need to be considered for respective electric field directions. Two types of drive states for the respective electric field directions are shown in FIGS. 3 and 4, respectively.

In FIGS. 3 and 4, VSBL_m denotes the waveform of a display signal voltage (source signal voltage) supplied to the source line SBL_m in an m-th column, and VGBL_n or the like denotes the waveform of a scanning voltage (gate signal voltage) supplied to the gate line GBL_n in an n-th row. VCSVtypeR1 and VCSVtypeR2 denote the waveforms of CS voltages as storage capacitor counter voltages supplied to the CS trunk lines CSVtypeR1 and CSVtypeR2, respectively, and VPEA_m,n and VPEB_m,n denote the voltage waveforms of liquid crystal capacitors of respective sub-pixels.

A first point to note in FIGS. 3 and 4 is that the periods of the voltages VCSVtypeR1 and VCSVtypeR2 of CS trunk line CSVtypeR1 and CSVtypeR1 are each a time period (1 H) equal to a horizontal scanning period.

A second point to note in FIGS. 3 and 4 is that VCSVtypeR1 and VCSVtypeR2 have the following phases. Focusing first on a phase difference between the CS trunk lines, VCSVtypeR2 is 0.5 H behind VCSVtypeR1. Focusing then on the voltages of the CS trunk lines and the voltages of gate lines, the voltages of the CS trunk lines and the voltages of the gate lines have the following phases. As can be seen from FIGS. 3 and 4, times when the voltages of the gate lines for each CS trunk line change from VgH to VgL coincide with times at the centers of respective flat portions of the voltage of the CS trunk line. That is, Td shown in FIGS. 3 and 4 has a value of 0.25 H. Note that Td may have any other value as long as Td is more than 0 H and less than 0.5 H.

Although the periods and phases of the voltages of the CS trunk lines have been described with reference to FIGS. 3 and 4, the CS trunk lines need not have such voltage waveforms and just need to satisfy either one of the following two conditions. A first condition is that a first voltage change in VCSVtypeR1 after the voltage of any of the associated gate lines changes from VgH to VgL is a voltage increase while a first voltage change in VCSVtypeR2 after the voltage of any of the associated gate lines changes from VgH to VgL is a voltage decrease. A second condition is that a first voltage change in VCSVtypeR1 after the voltage of any of the associated gate lines changes from VgH to VgL is a voltage decrease while a first voltage change in VCSVtypeR2 after the voltage of any of the associated gate lines changes from VgH to VgL is a voltage increase.

Figure 5:
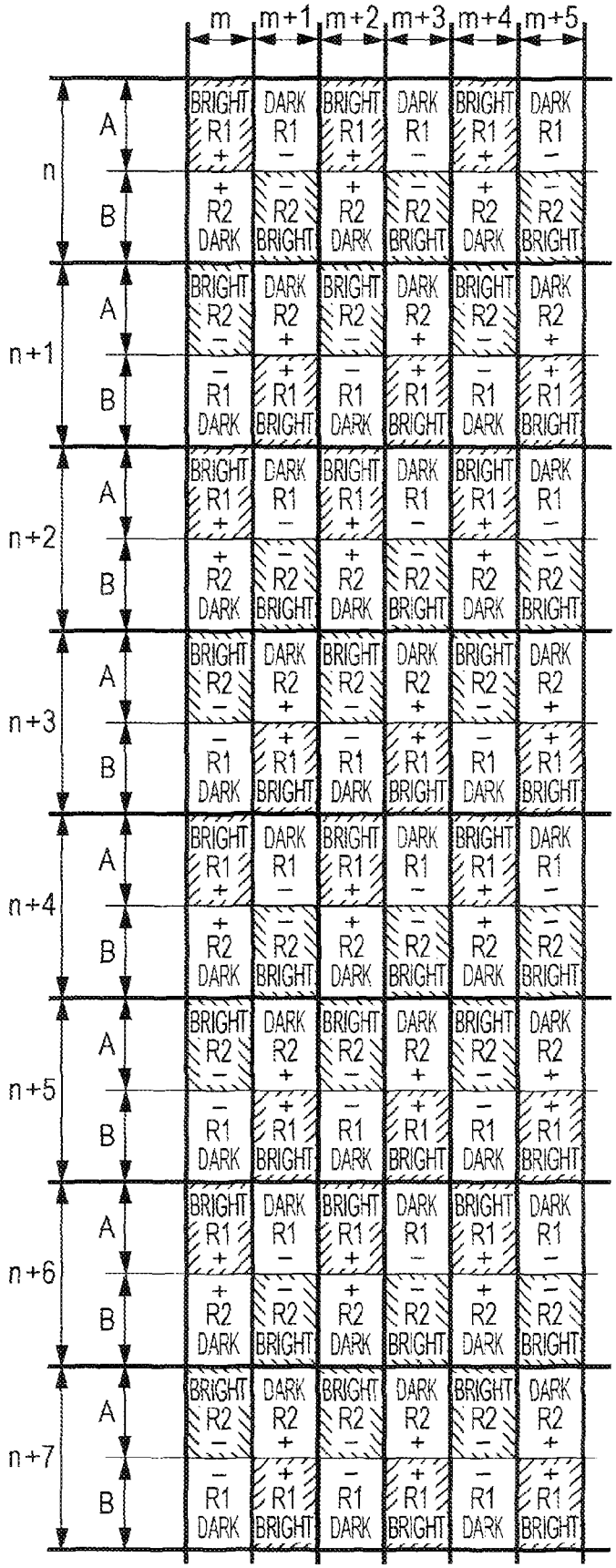
FIG. 5 is a schematic view showing a drive state of the liquid crystal display device according to the first embodiment.
Figure 6:
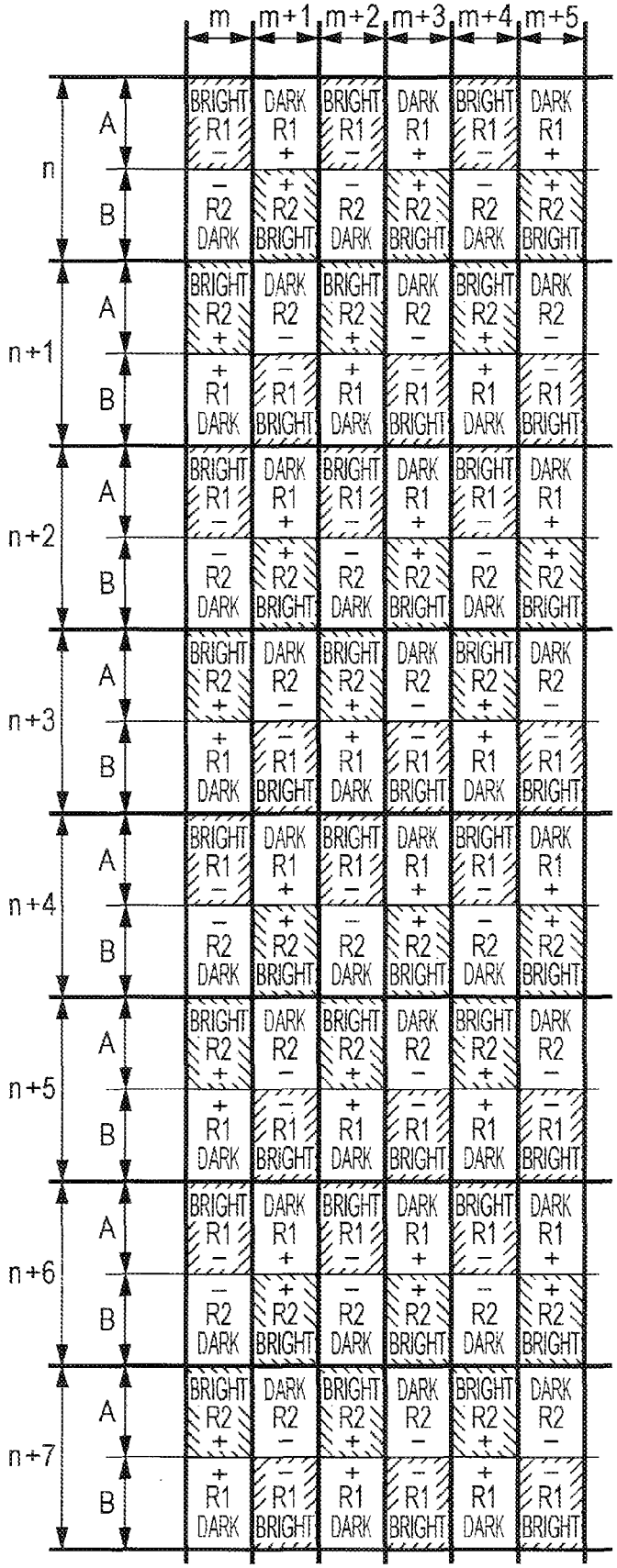
FIG. 6 is a schematic view showing a drive state of the liquid crystal display device according to the first embodiment.

FIGS. 5 and 6 summarize drive states of the liquid crystal display device. As in FIGS. 3 and 4, the drive states of the liquid crystal display device will be illustrated in the context of two separate cases different in combination of the drive voltage polarities of sub-pixels. The drive state in FIG. 5 corresponds to the drive voltage waveforms in FIG. 3 while the drive state in FIG. 6 corresponds to the drive voltage waveforms in FIG. 4.

FIGS. 5 and 6 are each a view schematically showing the drive state of pixels of (eight rows from the n-th row to an (n+7)-th row) by (six columns from the m-th column to an (m+5)-th column) among a plurality of pixels arranged in a matrix. Each pixel has sub-pixels different in luminance, that is, a sub-pixel marked "bright" and a sub-pixel marked "dark". These drawings are basically equivalent to FIG. 1 described earlier.

As shown in FIGS. 5 and 6, one pixel is composed of two sub-pixels different in luminance, that is, a high-luminance sub-pixel marked "bright" and a low-luminance sub-pixel marked "dark". Bright sub-pixels and dark sub-pixels are arranged in a checkered pattern.

(Frame Division Driving)

A specific configuration of frame division driving (sub-frame display) in the liquid crystal display device according to the present embodiment will be described.

In a driving method illustrated here, each pair of display luminances (each pair of display signal voltages) of two sub-frames corresponding to one frame is set so as to satisfy the following conditions.

A first condition is that the average of the display luminances of two sub-frames coincides with the luminance of an input video signal. In a conventional driving method shown in FIG. 7(*a*), the value of the display luminance of each frame corresponds one-to-one to the luminance of an input video signal. In contrast, in the present driving method shown in FIG. 7(*b*), the average of the display luminances of two sub-frames constituting each frame corresponds to the luminance of an input video signal. That is, an integrated value of the display luminances of the two sub-frames is set so as to correspond to the luminance of the input video signal.

A second condition is that the display luminances of respective sub-frames are set such that frames vary in the difference in display luminance between two sub-frames constituting one frame. The display luminances of respective sub-frames are preferably set so as to maximize the difference in display luminance between two sub-frames, as is illustrated here. For example, both in the case of low luminance and in the case of intermediate luminance in FIG. 7(*b*), the display luminance of a former one of two sub-frames is minimum luminance (black), and the display luminance of the latter sub-frame is twice the luminance of an input video signal. Both in the case of high luminance and in the case of maximum luminance in FIG. 7(*b*), a latter sub-frame is set to have maximum luminance, and the difference in luminance between the frames is expressed by the values of the display luminances of former sub-frames. In the shown example, a former one of two sub-frames has lower luminance. Conversely, a latter sub-frame may have lower luminance. Note that a former one of two sub-frames preferably has lower luminance because a video disturbance, which may appear at the start of writing of a former sub-frame in the event of a disturbance in video signal, such as a variation in a vertical scanning period (V-Total) of an input video signal, is advantageously less visible in that case.

Although an example in which one frame is divided into two sub-frames has been illustrated here, one frame may be divided into three or more sub-frames. If one frame is divided into three or more sub-frames, the second condition can be restated as follows.

The luminances of the three or more sub-frames are set such that one at the center of the one frame or one closest to the center of the three or more sub-frames has highest luminance and such that luminances decrease gradually from that sub-frame toward two sides. In this case, the display luminances of the other sub-frames are preferably set so as to maximize the difference in display luminance among the three or more sub-frames constituting the one frame. Note that the location of a sub-frame in a frame is a location on the time axis in the foregoing description and that, for example, the two sides of the central sub-frame refer to sides earlier and later than the central sub-frame. The display luminances of the sub-frames on the two sides need not be set so as to be symmetric with respect to the central sub-frame.

In the liquid crystal display device, the polarity of a display signal voltage supplied to a source line is inverted every frame cycle (every cycle of duration equal to that of one frame). Note that there are two approaches to inverting the polarity of a display signal voltage every frame cycle. One of them is to apply voltages with the same polarity during one frame. The other approach is to cause display signal voltages in two sub-frames in one frame to have opposite polarities and drive a latter sub-frame of the one frame and a former sub-frame of a succeeding frame with the same polarity.

Figure 7:
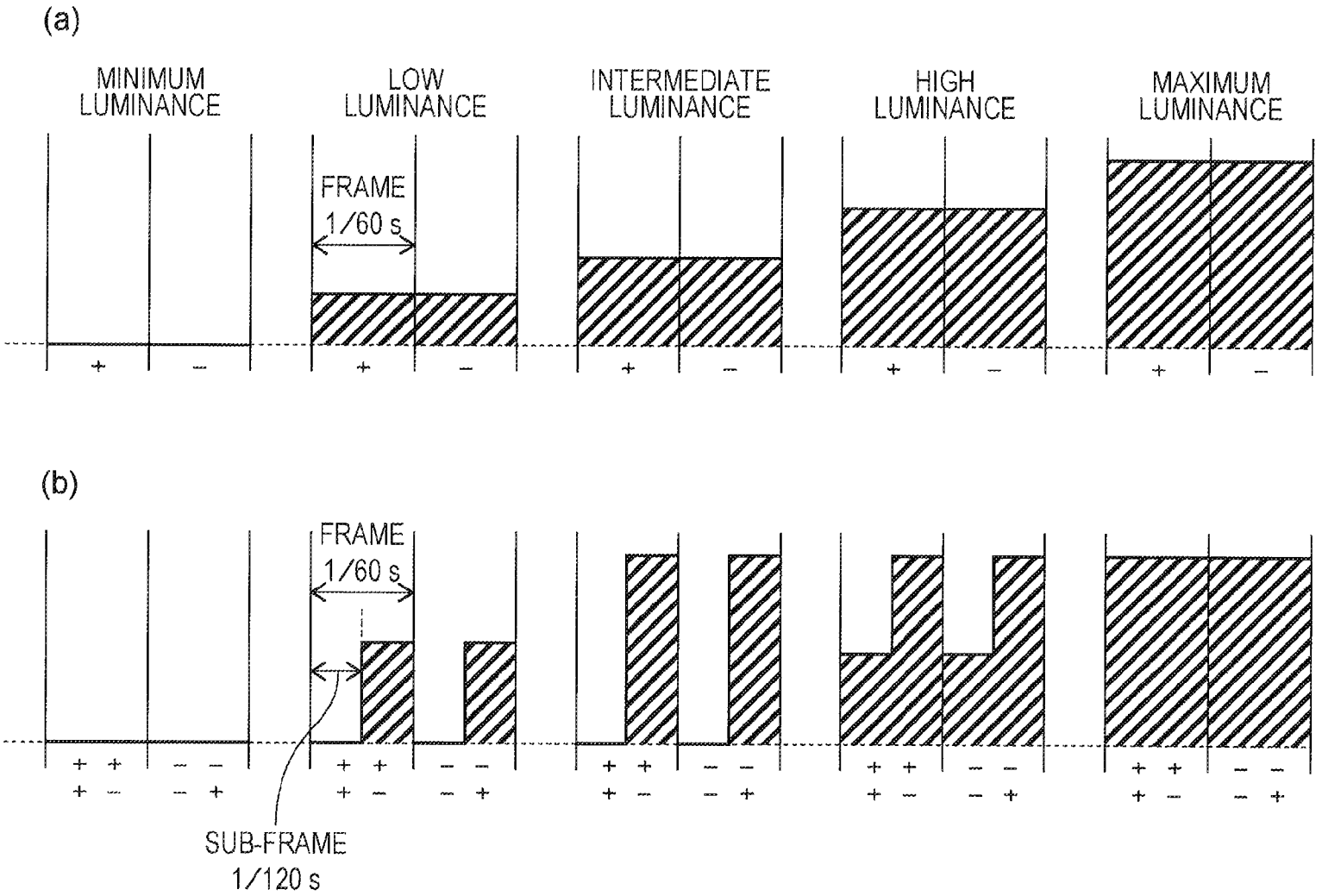
FIG. 7(*a*) is a schematic chart showing a normal driving method for a conventional liquid crystal display device, and FIG. 7(*b*) is a schematic chart showing a driving method for the liquid crystal display device according to the first embodiment.

FIG. 7(*a*) shows the relation between a voltage polarity (the polarity of an inter-electrode voltage) and a frame cycle when the former approach is taken. FIG. 7(*b*) shows the relation between a voltage polarity and a frame cycle when the latter approach is taken. Since an inter-electrode voltage is made to alternate in a frame cycle, even if sub-frames are significantly different in inter-electrode voltage, burn-in or flickering can be avoided.

Figure 8:
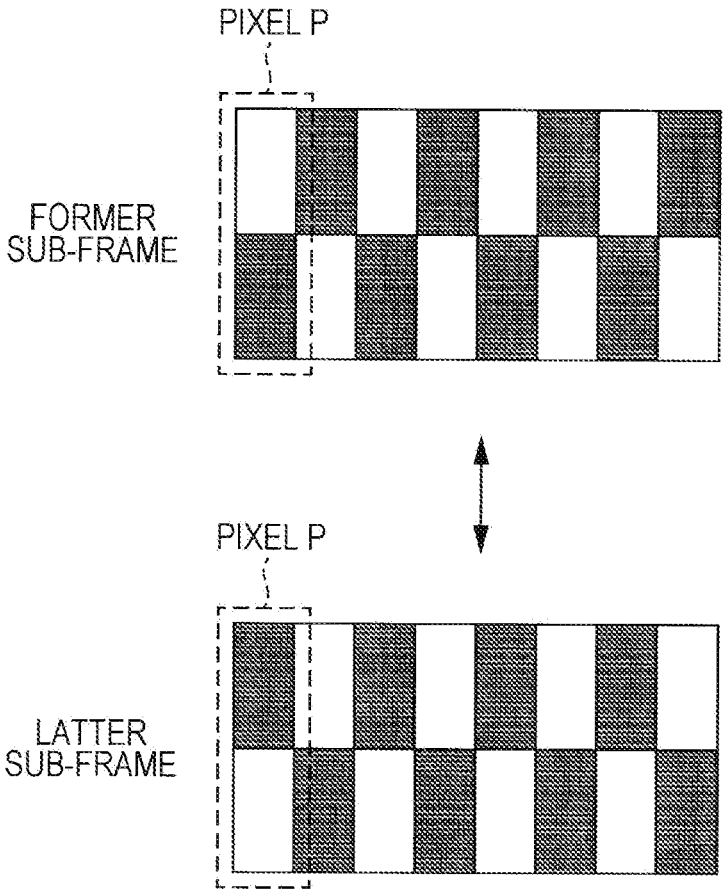
FIG. 8 is a schematic view showing display states of sub-pixels in sub-frames in the liquid crystal display device according to the first embodiment.

As described above, the liquid crystal display device performs frame division driving and pixel division driving. Thus, sub-pixels are arranged in a checkered pattern, and the bright/dark status of each sub-pixel switches from one to the other every sub-frame (see FIG. 8). In the liquid crystal display device with the above-described configuration, sub-frames are different from each other in a source signal voltage to be written to each sub-pixel.

Display Example

Figure 9:
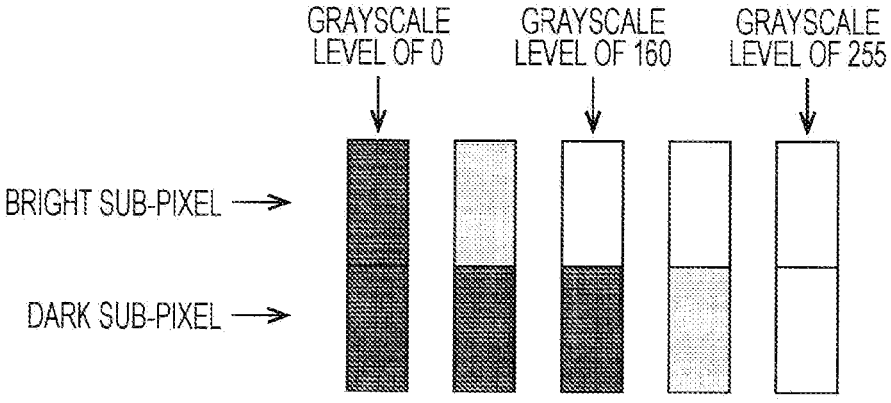
FIG. 9 is a schematic view showing a method for controlling a display signal in the liquid crystal display device according to the first embodiment.

An example will be illustrated below in which a linear image is displayed in a row direction in the liquid crystal display device. In this example, as shown in FIG. 9, a bright sub-pixel is lighted when the grayscale level not lower than 0 and lower than 160. A bright sub-pixel and a dark sub-pixel are lighted when the grayscale level is 160 to 255.

Figure 10:
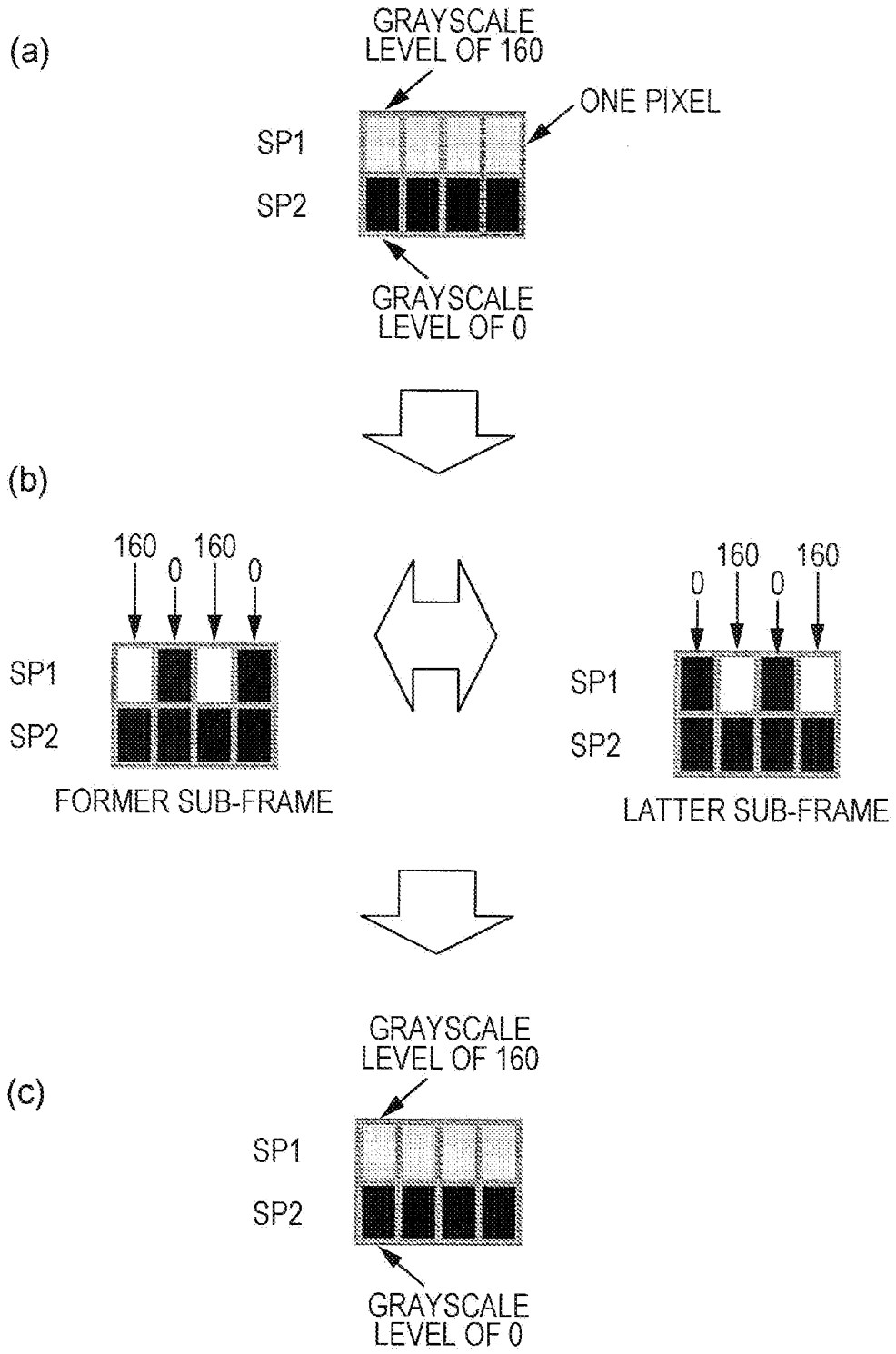
FIG. 10(*a*) is a schematic view showing images for four pixels corresponding to input signals, FIG. 10(*b*) is a schematic view showing display states in a former sub-frame and a latter sub-frame, and FIG. 10(*c*) is a schematic view showing display images on a display panel.

FIG. 10(*a*) shows images for four pixels corresponding to input signals, FIG. 10(*b*) shows display states in a former sub-frame and a latter sub-frame, and FIG. 10(*c*) shows a display image on a display panel.

As shown in FIG. 10(*a*), each input signal indicates that a first sub-pixel SP1 has a grayscale level of 160 and that a second sub-pixel SP2 has a grayscale level of 0. When the input signal is input to the liquid crystal display device, the grayscale level of each sub-pixel is controlled by a bright sub-pixel of each sub-frame. For example, as shown in FIG. 10(*b*), alternate signal voltages for a grayscale level of 160 and a grayscale level of 0 are input to individual source lines, and signal voltages are input such that one of a signal voltage for a grayscale level of 160 and a signal voltage for a grayscale level of 0 is input in a former sub-frame and such that the other is input in a latter sub-frame. Additionally, a signal voltage for a grayscale level of 160 is input to a source line for which the first sub-pixel SP1 is a bright sub-pixel while a signal voltage for a grayscale level of 0 is input to a source line for which the second sub-pixel SP2 is a bright sub-pixel. With this signal control, as shown in FIG. 10(*c*), time integration for one frame is performed. It is thus possible to display the first sub-pixel SP1 with a grayscale level of 160 and display the second sub-pixel SP2 with a grayscale level of 0.

A linear image can be displayed using a plurality of sub-pixels SP1 arranged in the row direction. That is, sub-pixels in one pixel can be independently controlled in luminance. An input signal having a longitudinal resolution twice the longitudinal resolution of the display panel can thus be displayed.

As described above, display quality with a longitudinal resolution (vertical resolution) twice that of a conventional liquid crystal display device can be achieved. In, for example, a FHD (1920 wide by 1080 high) liquid crystal panel, a high-resolution image (1920 wide by 2160 high) can be displayed.

Figure 11:
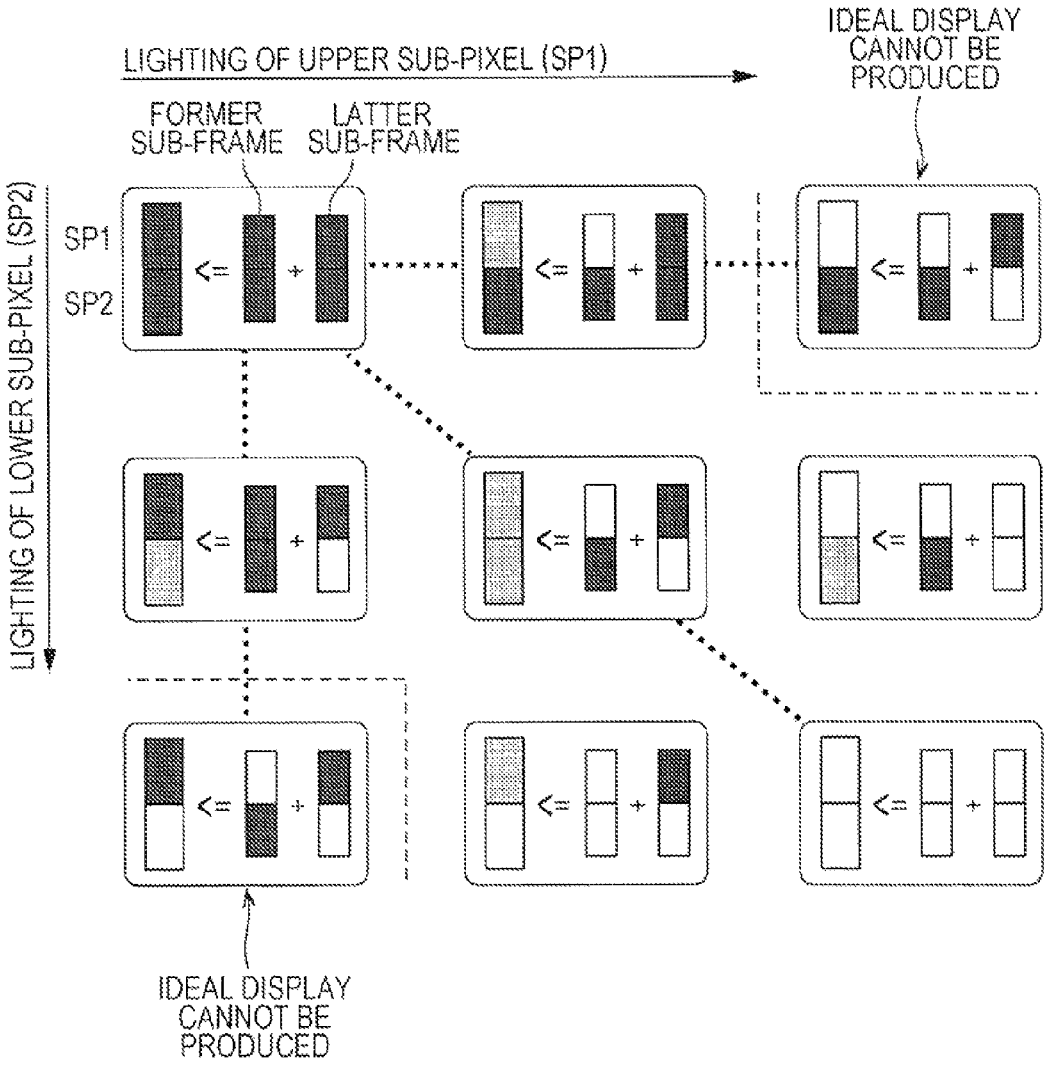
FIG. 11 is a view schematically showing a combination of lighting states in a former sub-frame and a latter sub-frame for a combination of sub-pixels desired to be displayed.

FIG. 11 schematically shows a combination of lighting states in a former sub-frame and a latter sub-frame for a combination of sub-pixels desired to be displayed. As shown in FIG. 11, although a part of a high-luminance region has a combination for which a desired display cannot be produced, sub-pixels in one pixel can be independently controlled in luminance for each of most grayscale levels.

Second Embodiment

Figure 12:
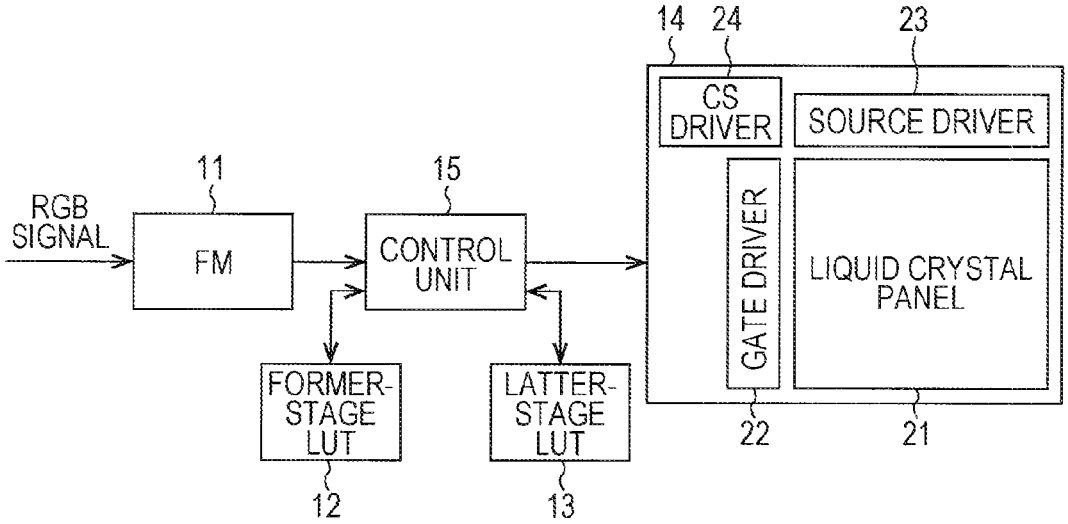
FIG. 12 is a schematic diagram showing the schematic configuration of a liquid crystal display device according to a second embodiment.

FIG. 12 is a schematic diagram showing the schematic configuration of a liquid crystal display device according to the present embodiment. The liquid crystal display device includes a frame memory (FM) 11, a former-stage LUT 12, a latter-stage LUT 13, a display unit 14, and a control unit 15.

The frame memory (image signal input unit) 11 accumulates, for one frame, image signals (for example, RGB signals) input from an external signal source. The former-stage LUT (look-up table) 12 and the latter-stage LUT 13 are each a correspondence table (conversion table) between an image signal input from the outside and a display signal to be output to the display unit 14. An image signal here has a resolution higher than that of a liquid crystal panel 21.

The liquid crystal display device produces a display from image signals for one frame input in one frame period at twice the frequency of a frame, using two sub-frames of the same size (duration). Note that the number of sub-frames is not limited to two and may be three or more. That is, the liquid crystal display device produces a display with each frame divided into a plurality of (m (m is an integer not less than 2)) sub-frames.

The former-stage LUT 12 is a correspondence table for a display signal (former-stage display signal) output in a former-stage sub-frame (former sub-frame). The latter-stage LUT 13 is a correspondence table for a display signal (latter-stage display signal) output in a latter-stage sub-frame (latter sub-frame).

As shown in FIG. 12, the display unit 14 includes the liquid crystal panel 21, a gate driver (scanning signal line drive circuit) 22, a source driver (data signal line drive circuit) 23, and a CS driver (storage capacitor line drive circuit) 24. The display unit 14 displays an image on the basis of an input display signal.

The liquid crystal panel 21 has a pixel division structure (multi-pixel structure). Specifically, the liquid crystal panel 21 has a plurality of pixels arranged in a row direction and in a column direction (in a matrix), and each pixel has a first sub-pixel and a second sub-pixel that produce displays with luminances different from each other for at least a given grayscale level.

Figure 13:
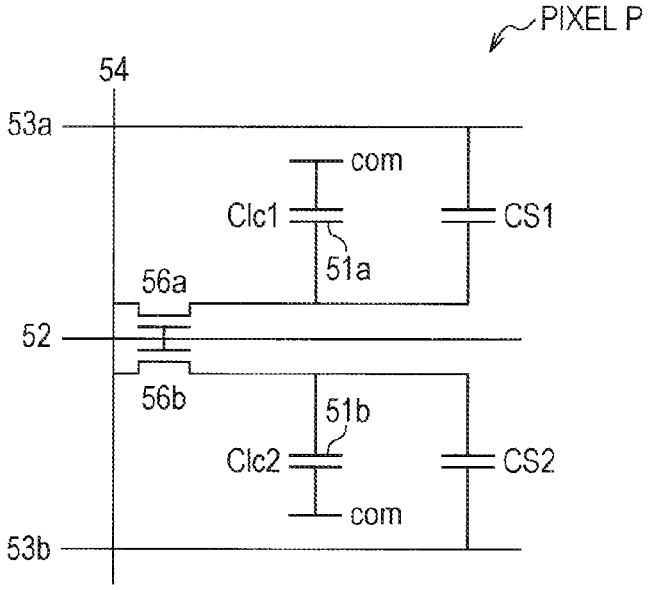
FIG. 13 is an equivalent circuit diagram showing one pixel of a liquid panel in the liquid crystal display device according to the second embodiment.
Figure 14:
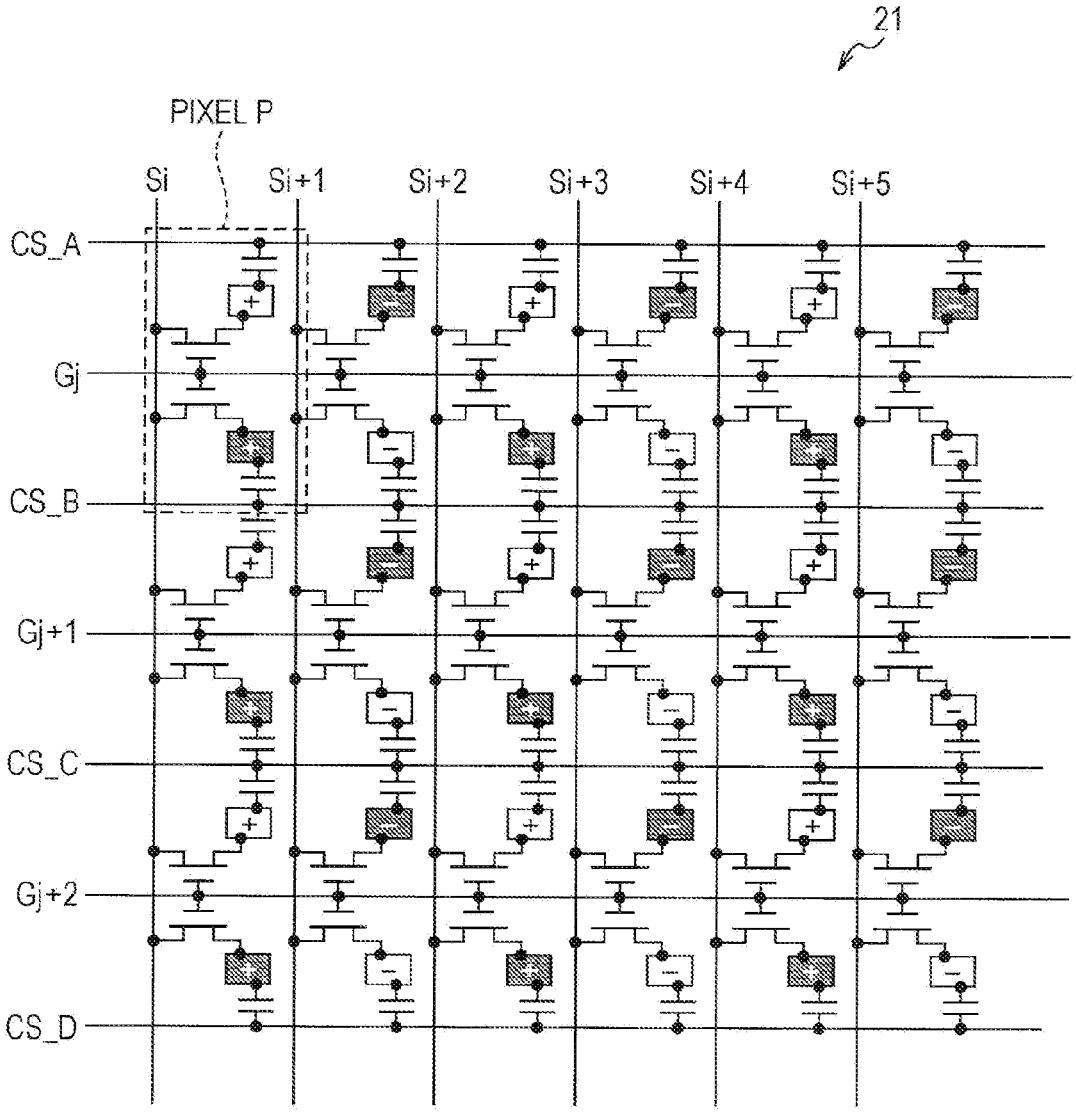
FIG. 14 is a plan view showing the relation of connection of a part of the liquid crystal panel in the liquid crystal display device according to the second embodiment.
Figure 15:
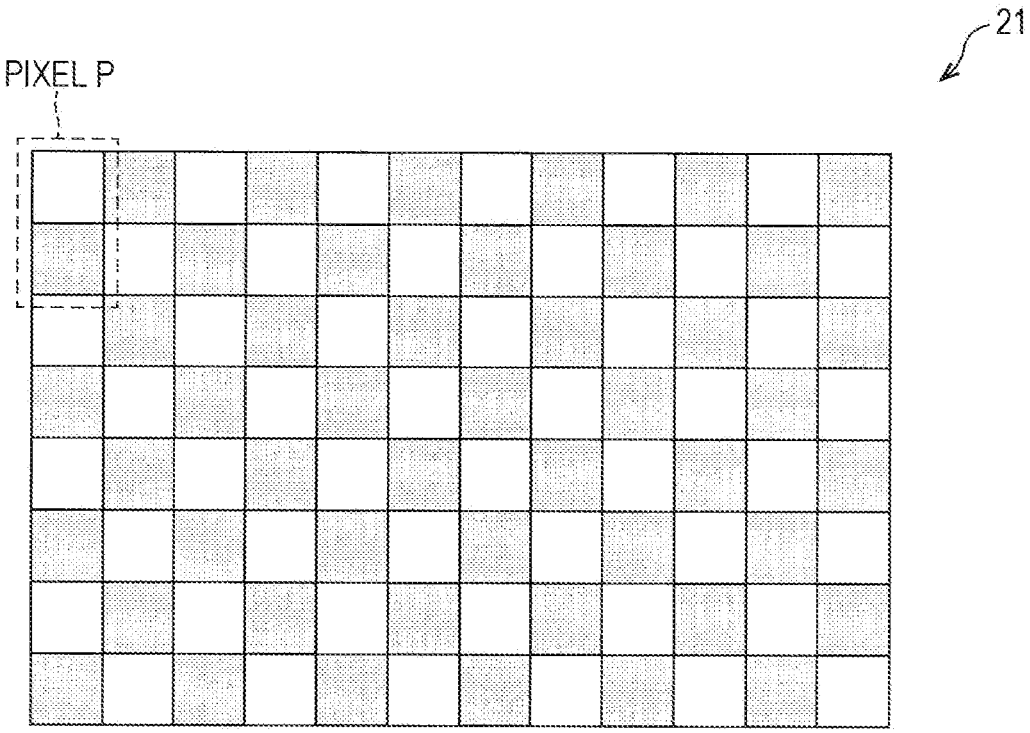
FIG. 15 is a plan view schematically showing a display state of a part of the liquid crystal panel in the liquid crystal display device according to the second embodiment.

FIG. 13 is an equivalent circuit diagram showing one pixel P of the liquid crystal panel 21. FIG. 14 is a plan view showing the relation of connection of a part of the liquid crystal panel 21. FIG. 15 is a plan view schematically showing the display state of a part of the liquid crystal panel 21.

As shown in FIG. 13, the pixel P includes a first sub-pixel electrode 51*a* and a second sub-pixel electrode 51*b*. The first sub-pixel electrode 51*a* is connected to a gate line 52 and a source line 54 via a first transistor 56*a*. The second sub-pixel electrode 51*b* is connected to the gate line 52 and the source line 54 via a second transistor 56*b*. A first liquid crystal capacitor Clc1 is formed between the first sub-pixel electrode 51*a* and a counter electrode com while a second liquid crystal capacitor Clc2 is formed between the second sub-pixel electrode 51*b* and the counter electrode com. A first storage capacitor CS1 is formed between the first sub-pixel electrode 51*a* and a first CS line (first storage capacitor line) 53*a* while a second storage capacitor CS2 is formed between the second sub-pixel electrode 51*b* and a second CS line (second storage capacitor line) 53*b*.

A source signal voltage (display signal voltage) is supplied in advance from the common source line 54 to the first sub-pixel electrode 51*a* and the second sub-pixel electrode 51*b*. After the transistors 56*a* and 56*b* are turned off, the voltages (storage capacitor line signals) of the first CS line 53*a* and the second CS line 53*b* are changed (level-shifted) so as to differ from each other. This change makes voltages applied to the first liquid crystal capacitor Clc1 and the second liquid crystal capacitor Clc2 different from each other, and a bright sub-pixel with a relatively high luminance and a dark sub-pixel with a relatively low luminance are formed in the one pixel. A specific configuration example of the liquid crystal display device in which a bright sub-pixel and a dark sub-pixel are formed in the one pixel will be described later.

As shown in FIGS. 14 and 15, in the liquid crystal panel 21, bright sub-pixels and dark sub-pixels (hatched sub-pixels) are arranged in a checkered pattern.

The control unit 15 is a brain of the liquid crystal display device which controls all operations in the liquid crystal display device. The control unit 15 generates display signals from image signals accumulated in the frame memory 11 using the former-stage LUT 12 and the latter-stage LUT 13 and outputs the display signals to the display unit 14.

That is, the control unit 15 accumulates image signals which are sent at a normal output frequency (normal clocks at, for example, 25 MHz) in the frame memory 11. The control unit 15 then outputs such image signals twice from the frame memory 11 in accordance with clocks having a frequency double that of normal clocks (double clocks at 50 MHz).

The control unit 15 generates former-stage display signals from image signals to be output for a first time, using the former-stage LUT 12. After that, the control unit 15 generates latter-stage display signals from image signals to be output for a second time, using the latter-stage LUT 13. The control unit 15 sequentially outputs these display signals to the display unit 14 in accordance with double clocks.

The control unit 15 also changes pixel potentials written to respective sub-pixel electrodes by changing (level-shifting) the voltage levels of CS signals supplied to the first CS line 53*a* and the second CS line 53*b* to form bright sub-pixels and dark sub-pixels.

The display unit 14 displays, once in every frame period, images different from each other on the basis of two sequentially input display signals (turns on all gate lines of the liquid crystal panel 21 once in each of two sub-frame periods) and displays an image formed by bright pixels and dark pixels in each sub-frame. Note that a specific operation of outputting a display signal will be described later.

(Frame Division Driving)

A specific configuration of frame division driving (sub-frame display) in the liquid crystal display device according to the present embodiment will be described. Note that, for example, the configuration described in "WO 2006/093163" can be applied to the frame division driving.

How former-stage display signals and latter-stage display signals are generated by the control unit 15 will be described. The typical display luminance in a liquid crystal panel (the luminance of an image displayed on the panel) will be described first.

If an image is generated from ordinary 8-bit data and is displayed over one frame without use of sub-frames (in the case of normal hold display that turns on all gate lines of a liquid crystal panel only once in every frame period), the luminance grayscale level of the display signal (signal grayscale level) ranges from 0 to 255.

A signal grayscale level and display luminance in a liquid crystal panel are approximately represented by Equation (1) below:

$$((T-T0)/(T\max-T0))=(L/L\max)\hat{}\gamma \quad (1)$$

where L is a signal grayscale level (frame grayscale level) when an image is displayed over one frame (an image is displayed through normal hold display), Lmax is a maximum luminance grayscale level (255), T is display luminance, Tmax is maximum luminance (luminance when L=Lmax=255; white), T0 is minimum luminance (luminance when L=0; black), and γ is a correction value (typically, 2.2). Note that T0 is not 0 in the actual liquid crystal panel 21. However, T0 is assumed to be 0 in the following description for illustrative simplicity.

Figure 16:
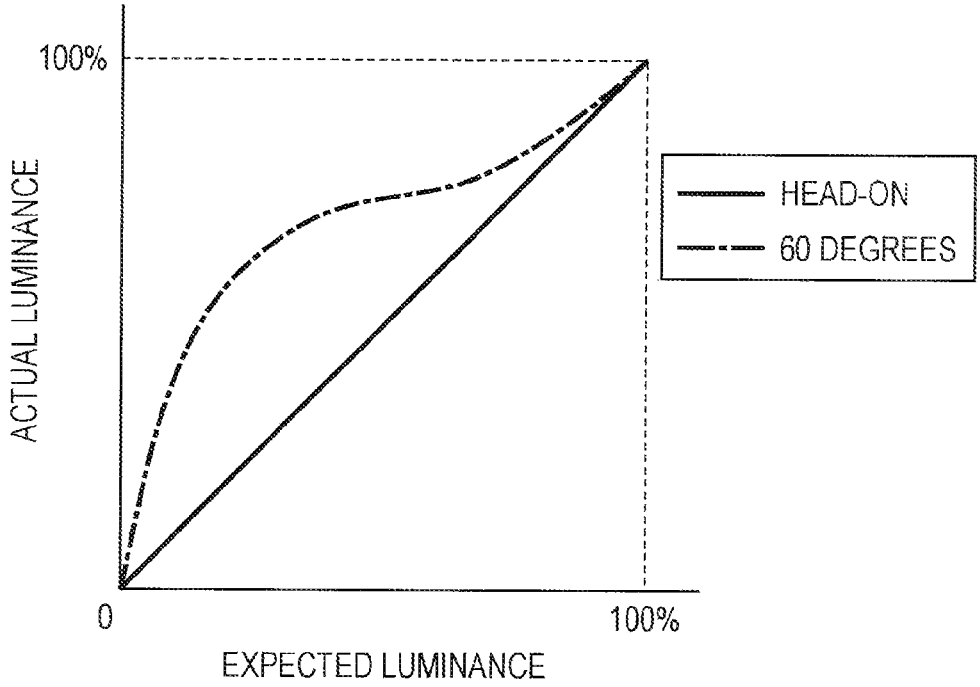
FIG. 16 is a graph showing display luminance output from the liquid crystal panel in the case of normal hold display.

Display luminance T output from the liquid crystal panel 21 in this case (in the case of normal hold display) is shown in a graphic form in FIG. 16. In the graph, the abscissa represents "luminance to be output (expected luminance; a value commensurate with a signal grayscale level corresponding to the display luminance T above)" while the ordinate represents "actually output luminance (actual luminance)".

As can be seen from the graph, in this case, the two luminances described above are equal when the liquid crystal panel 21 is viewed head-on (at a viewing angle of 0°).

In contrast, at a viewing angle of 60°, the actual luminance increases due to a change in grayscale γ characteristic, in the case of intermediate luminance.

Display luminance in the liquid crystal display device will be described.

In the liquid crystal display device, the control unit 15 is designed to give gradation expression for each sub-pixel so as to satisfy the conditions:

(a) "The total sum of the luminances (display luminances) of images displayed by the display unit 14 in a former sub-frame and a latter sub-frame (integrated luminance over one frame) is equal to the display luminance over one frame in the case of normal display"; and (b) "One of the sub-frames is either black (minimum luminance) or white (maximum luminance)".

To this end, the liquid crystal display device is designed such that the control unit 15 equally divides a frame into two sub-frames, in one of which a display with luminance up to half the maximum luminance is produced.

That is, to output luminance up to half the maximum luminance (threshold luminance; Tmax/2) over one frame (in the case of low luminance), the control unit 15 sets the display luminance of a former sub-frame to the minimum luminance (black) and adjusts only the display luminance of a latter sub-frame to give gradation expression (gives gradation expression using only the latter sub-frame). In this case, integrated luminance over one frame is equal to "(the minimum luminance+the luminance of the latter sub-frame)/2".

To output luminance higher than the threshold luminance (in the case of high luminance), the control unit 15 sets the display luminance of a latter sub-frame to the maximum luminance (white) and adjusts the display luminance of a former sub-frame to give gradation expression. In this case, integrated luminance over one frame is equal to "(the luminance of the former sub-frame+the maximum luminance)/2".

Setting of the signal grayscale levels of display signals (a former-stage display signal and a latter-stage display signal) for obtaining the above-described display luminance will be specifically described. Note that the signal grayscale level setting is performed by the control unit 15.

The control unit 15 calculates, in advance, a frame grayscale level corresponding to the threshold luminance (Tmax/2) using Equation (1) above. That is, the frame grayscale level (a threshold luminance grayscale level Lt) corresponding to the display luminance is derived from Equation (1) and given by:

$$Lt=0.5\hat{}(1/\gamma)\times L\max \quad (2)$$

$$\text{where } L\max=T\max\hat{}\gamma \quad (2a)$$

When displaying an image, the control unit 15 calculates the frame grayscale level L from an image signal output from the frame memory 11.

If L is not more than Lt, the control unit 15 controls the former-stage LUT 12 to set the luminance grayscale level (denoted by F) of a former-stage display signal to a minimum (0).

The control unit 15 uses the latter-stage LUT 13 to set the luminance grayscale level (denoted by R) of a latter-stage display signal on the basis of Equation (1) so as to satisfy:

$$R=0.5\hat{}(1/\gamma)\times L \quad (3)$$

If the frame grayscale level L is more than Lt, the control unit 15 sets the luminance grayscale level R of the latter-stage display signal to a maximum (255).

The control unit 15 sets the luminance grayscale level F in a former sub-frame on the basis of Equation (1) so as to satisfy:

$$F=(L\hat{}\gamma-0.5\times L\max\hat{}\gamma)\hat{}(1/\gamma) \quad (4)$$

An operation of outputting a display signal in the liquid crystal display device will be described in more detail.

Note that the liquid crystal panel 21 is assumed to have a×b pixels in the following description. In this case, the control unit 15 accumulates former-stage display signals for (a) pixels of a first gate line in the source driver 23 in accordance with double clocks.

The control unit 15 controls the gate driver 22 to turn on the first gate line and writes the former-stage display signals to the pixels of the gate line. After that, the control unit 15 similarly turns on second to b-th gate lines in accordance with double clocks while changing former-stage display signals to be accumulated in the source driver 23. Thus, former-stage display signals can be written to all pixels within a period half one frame (a half-frame period).

The control unit 15 performs the same operation to write latter-stage display signals to the pixels of all the gate lines within the remaining half-frame period. Thus, former-stage display signals and latter-stage display signals are written to the pixels for equal time periods (half-frame periods), respectively.

Note that, as will be described later in detail, the control unit 15 selects all the gate lines by, for example, sequentially turning on gate lines in odd-numbered rows in a first-half quarter-frame period of each half-frame period and then sequentially turning on gate lines in even-numbered rows in a second-half quarter-frame period.

Figure 17:
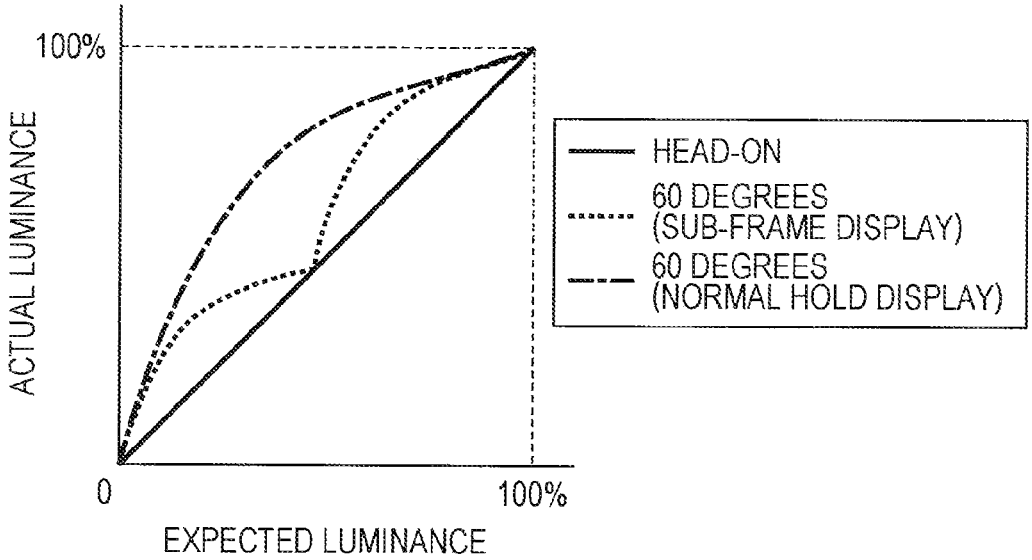
FIG. 17 is a graph showing a result of sub-frame display that outputs a former-stage display signal and a latter-stage display signal in separate former and latter sub-frames in the liquid crystal display device according to the second embodiment.

FIG. 17 is a graph showing results (a broken line and a solid line) of such sub-frame display that separately outputs former-stage display signals and latter-stage display signals in former and latter sub-frames, together with the results (an alternate long and short dash line and a solid line) shown in FIG. 16.

The liquid crystal display device uses the liquid crystal panel 21 (see FIG. 16), in which a deviation of actual luminance from expected luminance (equivalent to the solid line) at a large viewing angle is a minimum (0) when display luminance is minimum or maximum luminance and is the largest when the display luminance is intermediate luminance (close to the threshold luminance).

The liquid crystal display device performs sub-frame display that divides one frame into sub-frames. Additionally, the liquid crystal display device sets the durations of two sub-frames to be equal. In the case of low luminance, a former sub-frame is set for black display within a range which does not change integrated luminance over one frame, and only a latter sub-frame is used to produce a display. Since a deviation is minimized in the former sub-frame, the total deviation in the two sub-frames can be reduced to about half, as indicated by the broken line in FIG. 17.

In contrast, in the case of high luminance, a latter sub-frame is set for white display within a range which does not change integrated luminance over one frame, and only the luminance of a former sub-frame is adjusted to produce a display. Since a deviation is minimized in the latter sub-frame, the total deviation in the two sub-frames can be reduced to about half in this case as well, as indicated by the broken line in FIG. 17.

As described above, the liquid crystal display device is capable of reducing a total deviation to about half that in a configuration for normal hold display (a configuration in which an image is displayed over one frame without use of sub-frames). It is thus possible to inhibit occurrence of a phenomenon in which a halftone image becomes bright to appear whitish (whitish appearance phenomenon), as shown in FIG. 16.

Note that the durations of a former sub-frame and a latter sub-frame are set to be equal in the present embodiment. This is to provide a display with luminance up to half a maximum value in one sub-frame. The durations of the sub-frames, however, may be set to values different from each other.

The liquid crystal panel 21 is preferably driven with an alternating current to avoid so-called burn-in.

In the liquid crystal display device, sub-frames are different from each other in the value (an absolute value) of a voltage applied between pixel electrodes. If the polarity of an inter-electrode voltage is inverted every sub-frame cycle, the applied inter-electrode voltage is biased due to the difference in voltage value between a former sub-frame and a latter sub-frame. Thus, if the liquid crystal panel 21 is driven for a long time, electric charges accumulate at electrodes, which may cause burn-in, flickering, or the like.

For this reason, in the liquid crystal display device, the polarity of an inter-electrode voltage is inverted every frame cycle (every cycle of duration equal to that of one frame). Note that there are two approaches to inverting the polarity of an inter-electrode voltage every frame cycle. One of them is to apply voltages with the same polarity during one frame. The other approach is to cause inter-electrode voltages to have opposite polarities for two sub-frames in one frame and drive a latter sub-frame of the one frame and a former sub-frame of a succeeding frame with the same polarity.

Figure 18:
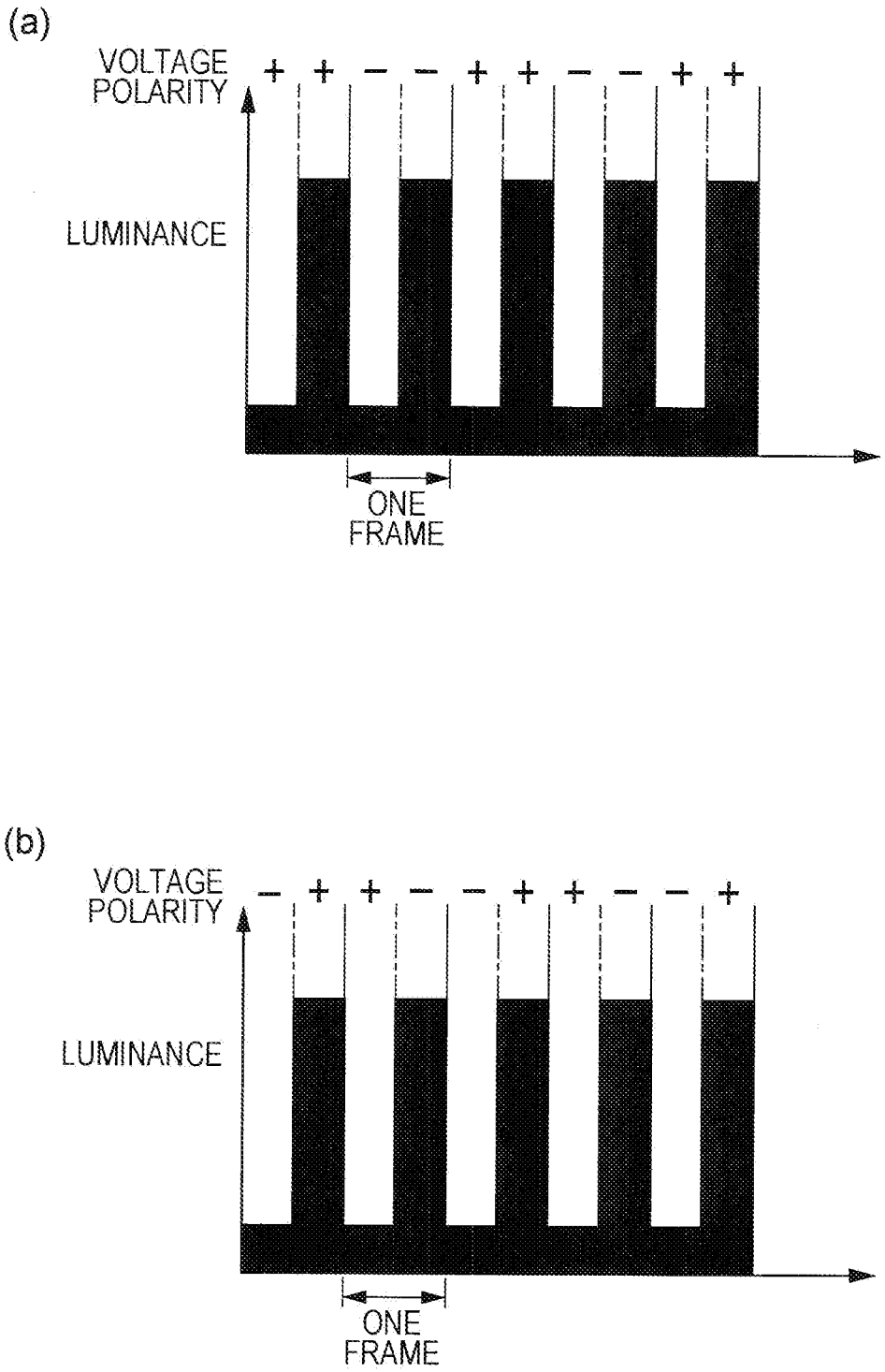
FIG. 18(*a*) is a chart showing the relation between a voltage polarity (the polarity of an inter-electrode voltage) and a frame cycle in a first method that inverts the polarity of the inter-electrode voltage every frame cycle, and FIG. 18(*b*) is a chart showing the relation between a voltage polarity (the polarity of an inter-electrode voltage) and a frame cycle in a second method that inverts the polarity of the inter-electrode voltage every frame cycle.

FIG. 18(*a*) shows the relation between a voltage polarity (the polarity of an inter-electrode voltage) and a frame cycle when the former approach is taken. FIG. 18(*b*) shows the relation between a voltage polarity and a frame cycle when the latter approach is taken. Since an inter-electrode voltage is made to alternate in a frame cycle, even if sub-frames are significantly different in inter-electrode voltage, burn-in or flickering can be avoided.

As described above, the liquid crystal display device drives the liquid crystal panel 21 through sub-frame display, which inhibits occurrence of a whitish appearance phenomenon. However, the effectiveness of sub-frame display may be reduced if the response rate of liquid crystals (a rate at which the voltage on liquid crystals (an inter-electrode voltage) becomes equal to an applied voltage) is low. That is, at the time of normal hold display on a TFT liquid crystal panel, one liquid crystal state corresponds to a given luminance grayscale level. Thus, the response characteristics of liquid crystals do not depend on the luminance grayscale level of a display signal.

Figure 19:
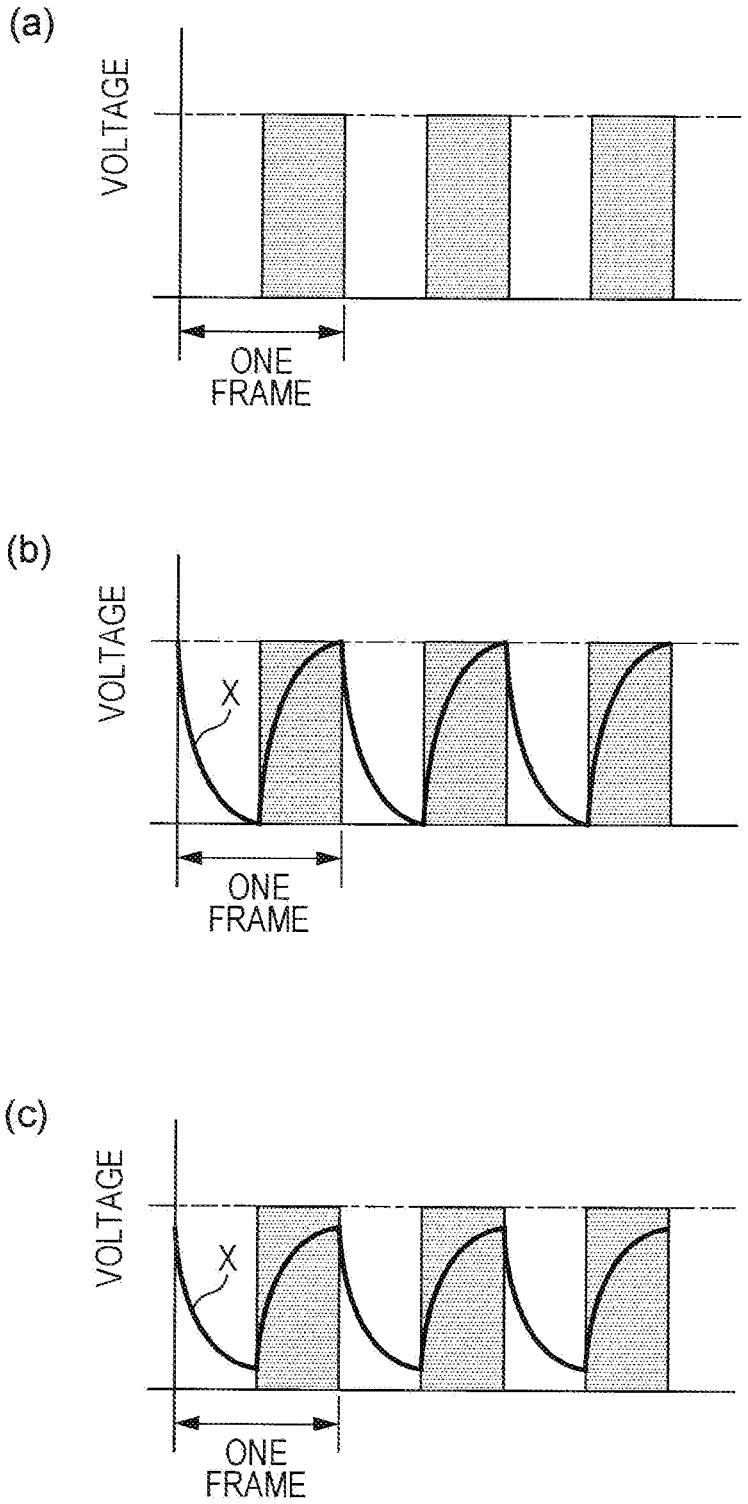
FIG. 19(*a*) is a chart showing change in a voltage to be applied to liquid crystals in one frame at the time of displaying a display signal with an intermediate grayscale level, for which a former sub-frame has maximum luminance (white) and a latter sub-frame has minimum luminance (black), FIG. 19(*b*) is a chart showing change in an inter-electrode voltage, and FIG. 19(*c*) is a chart showing change in an inter-electrode voltage when the response rate of liquid crystals is low.

At the time of sub-frame display as in the liquid crystal display device, to display a display signal with an intermediate grayscale level, for which a former sub-frame has maximum luminance (white) and a latter sub-frame has minimum luminance (black), the voltage applied to liquid crystals during one frame varies, as shown in FIG. 19(*a*). An inter-electrode voltage changes in accordance with the response rate (response characteristics) of liquid crystals, as indicated by a solid line X in FIG. 19(*b*).

If a halftone display is produced when the response rate of liquid crystals is low, an inter-electrode voltage (solid line X) changes, as shown in FIG. 19(*c*). In this case, the display luminance of a former sub-frame is not minimum luminance, and the display luminance of a latter sub-frame is not maximum luminance.

Figure 20:
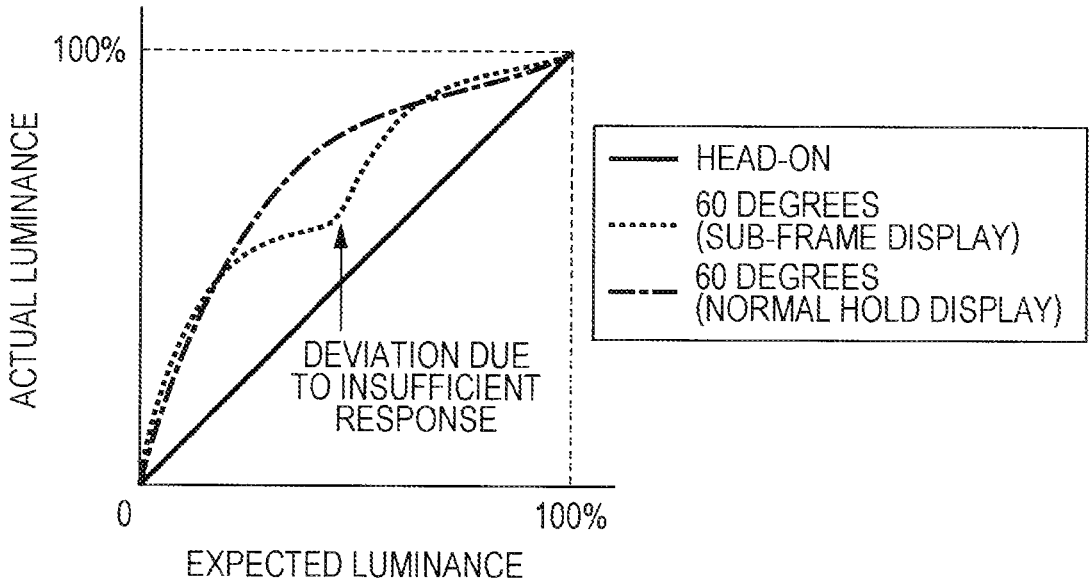
FIG. 20 is a chart showing the relation between expected luminance and actual luminance in the liquid crystal display device according to the second embodiment.

For this reason, the relation between expected luminance and actual luminance is as shown in FIG. 20. That is, even through sub-frame display, a display with luminance (minimum luminance and maximum luminance), for which the difference between the expected luminance and the actual luminance (the deviation of the actual luminance from the expected luminance) at a large viewing angle is small, cannot be produced. This reduces the effect of inhibiting occurrence of a whitish appearance phenomenon.

To perform good sub-frame display as in the liquid crystal display device, the response rate of liquid crystals in the liquid crystal panel 21 is preferably designed so as to satisfy the following conditions (c) and (d):

(c) When a voltage signal (generated from a display signal by the source driver 23) for maximum luminance (white corresponding to maximum brightness) is given to liquid crystals providing a display with minimum luminance (black corresponding to minimum brightness), the voltage on liquid crystals (an inter-electrode voltage) reaches a value 90% or more of the voltage of the voltage signal in a shorter one of two sub-frame periods (actual brightness as viewed head-on reaches 90% of the maximum brightness); and (d) If a voltage signal for minimum luminance (black) is given to liquid crystals providing a display with maximum luminance (white), the voltage on liquid crystals (an inter-electrode voltage) reaches a value 5% or less of the voltage of the voltage signal in a shorter one of two sub-frame periods (actual brightness as viewed head-on reaches 5% of the minimum brightness).

Note that, in the present embodiment, a former sub-frame is set for black and that only a latter sub-frame is used to give gradation expression, in the case of low luminance. The same display is achieved even if settings for the two sub-frames are interchanged (the latter sub-frame is set for black, and only the former sub-frame is used to give gradation expression, in the case of low luminance).

In the present embodiment, the luminance grayscale levels (signal grayscale levels) of display signals (a former-stage display signal and a latter-stage display signal) are set using Equation (1). However, an actual panel has luminance even in the case of black display (with a grayscale level of 0), and the response rate of liquid crystals is finite. Thus, these factors are preferably taken into account in the setting of signal grayscale levels. That is, it is preferable to display an actual image on the liquid crystal panel 21, actually measure the relation between a signal grayscale level and display luminance, and determine a LUT (output table) which fits Equation (1) from a result of the actual measurement.

If a source driver for normal hold display is used as the source driver 23 of the present display device, voltage signals are output to pixels (liquid crystals) in accordance with input signal grayscale levels (the luminance grayscale levels of display signals) such that display luminance obtained by substituting $\gamma=2.2$ into Equation (1) can be obtained.

The source driver 23 outputs, without change, voltage signals which are used in normal hold display in accordance with input signal grayscale levels in each sub-frame, even at the time of sub-frame display.

This voltage signal output method, however, may fail to make the total luminance in one frame in sub-frame display equal to a value in normal hold display (may fail to fully express a signal grayscale level).

Thus, in sub-frame display, the source driver 23 is preferably designed so as to output a voltage signal corresponding to divided luminance.

That is, the source driver 23 is preferably set so as to finely adjust a voltage applied to liquid crystals (an inter-electrode voltage) in accordance with a signal grayscale level.

To this end, it is preferable to design the source driver 23 for sub-frame display to allow the fine adjustment.

In the present embodiment, the liquid crystal panel 21 is a VA panel. The present invention, however, is not limited to this. The liquid crystal display device can inhibit occurrence of a whitish appearance phenomenon through sub-frame display even if a liquid crystal panel of a mode other than VA mode is used.

That is, sub-frame display by the liquid crystal display device is capable of inhibiting occurrence of a whitish appearance phenomenon on a liquid crystal panel in which actual luminance (actual brightness) deviates from expected luminance (expected brightness) at a large viewing angle (a liquid crystal panel of a mode in which grayscale gamma changes with a viewing angle characteristic). The sub-frame display by the liquid crystal display device is particularly effective for a liquid crystal panel having the property of increasing in display luminance with increase in viewing angle.

The liquid crystal panel 21 in the liquid crystal display device may be normally black (NB) or normally white (NW). Additionally, in the present display device, any other display panel (for example, an organic EL panel or a plasma display panel) may be used instead of the liquid crystal panel 21.

In the present embodiment, each frame may be designed to be divided at a ratio of 1:n or n:1 (n is a natural number not less than 1).

(Pixel Division Driving)

The liquid crystal display device performs pixel division driving (multi-pixel driving) in addition to the above-described frame division driving (sub-frame display). A configuration example of a pixel division structure (multi-pixel structure) will be described.

Figure 21:
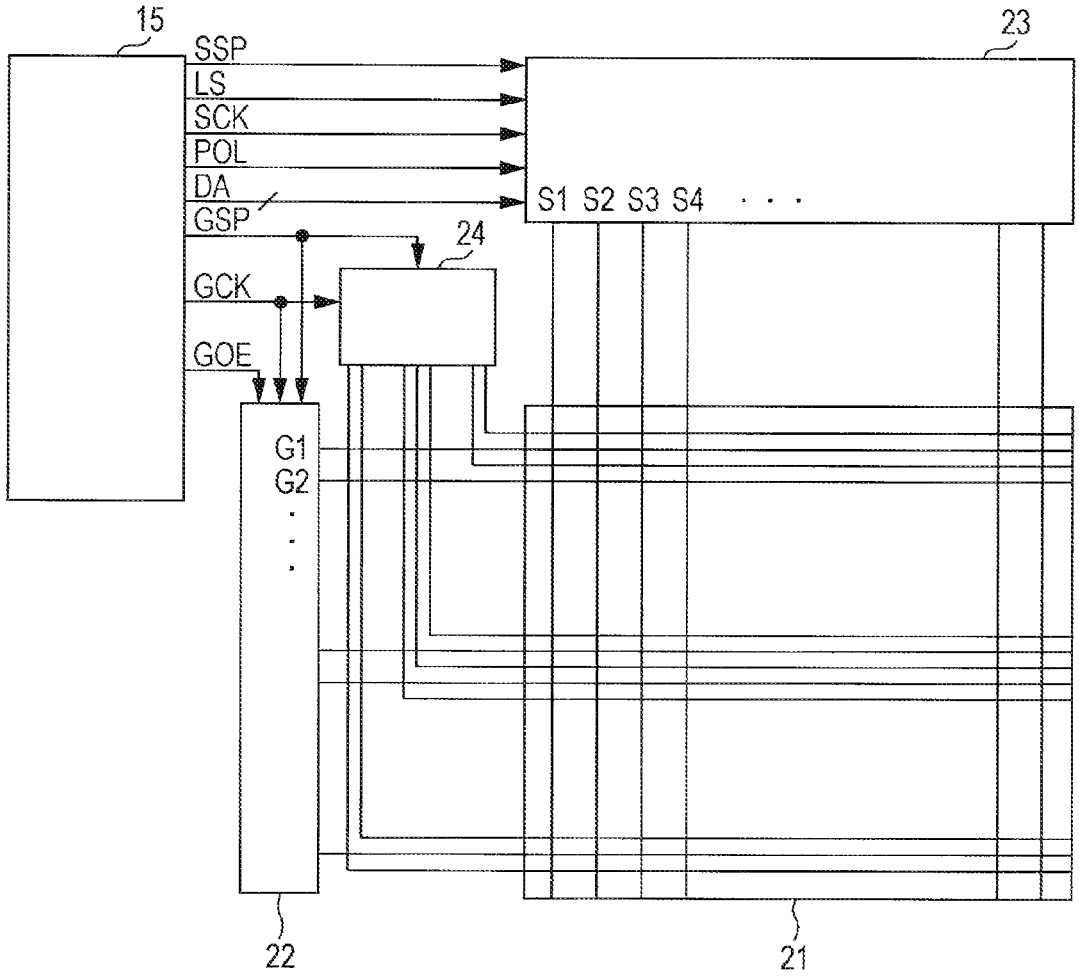
FIG. 21 is a plan view showing the schematic configuration of the liquid crystal display device according to the second embodiment.
Figure 22:
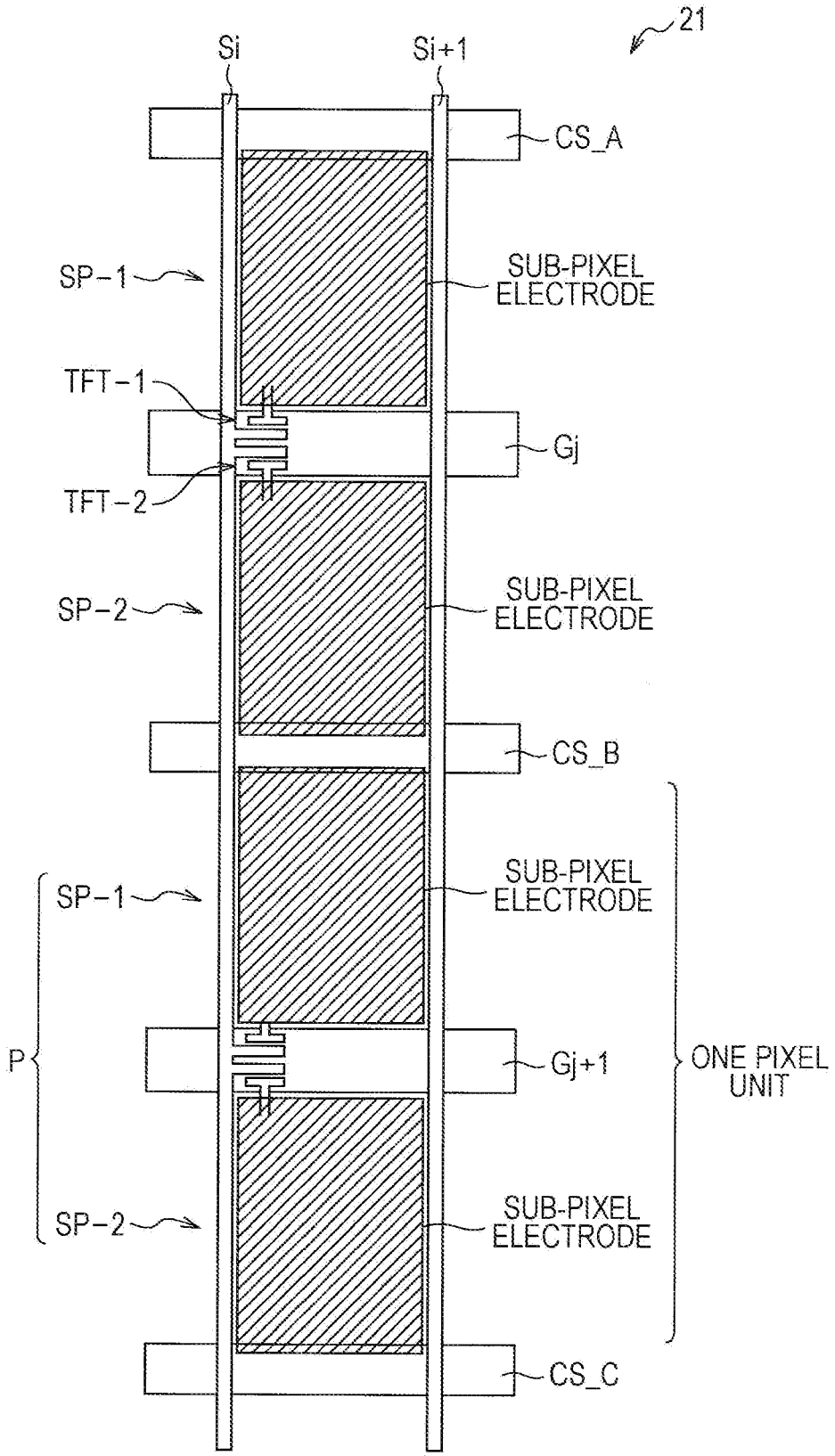
FIG. 22 is a plan view showing the schematic configuration of two pixels adjacent in a column direction in the liquid crystal display device according to the second embodiment.

FIG. 21 is a plan view showing the schematic configuration of the liquid crystal display device. FIG. 22 is a plan view showing the schematic configuration of two pixels adjacent in the column direction. An equivalent circuit of each pixel is as shown in FIG. 13.

The liquid crystal display device includes the liquid crystal panel 21, the source driver 23 (data signal line drive circuit) that supplies source signal voltages to source lines (data signal lines) S1 . . . (also denoted by Si), the gate driver 22 (scanning signal line drive circuit) that supplies gate signal voltages to gate lines (scanning signal lines) G1 . . . , the CS driver 24 that supplies CS voltages (storage capacitor line signals) to CS lines (storage capacitor lines) CS1 . . . , and the control unit 15 that controls the source driver 23, the gate driver 22, and the CS driver 24.

Each pixel of the liquid crystal panel 21 has two sub-pixels. A first sub-pixel SP–1 in FIG. 22 has the first liquid crystal capacitor Clc1 and the first storage capacitor CS1 shown in FIG. 13 while a second sub-pixel SP-2 in FIG. 22 has the second liquid crystal capacitor Clc2 and the second storage capacitor CS2 shown in FIG. 13. As shown in FIG. 13, the first liquid crystal capacitor Clc1 is formed from the first sub-pixel electrode 51*a*, the counter electrode com, and the liquid crystal layer between the electrodes. The second liquid crystal capacitor Clc2 is formed from the second sub-pixel electrode 51*b*, the counter electrode com, and the liquid crystal layer between the electrodes. The counter electrode com is provided so as to be shared by the two sub-pixels. In general, a counter electrode com is provided so as to be shared by all pixels within a display region. Note that a display region may be divided into a plurality of regions in a large-size liquid crystal panel.

The control unit 15 generates and outputs, as signals for display on the liquid crystal panel 21, a data start pulse signal SSP, a data clock signal SCK, a latch strobe signal LS, a signal POL for controlling the polarity of a data signal, a digital image signal DA representing an image to be displayed, a gate start pulse signal GSP, a gate clock signal GCK, and a gate driver output control signal GOE.

The digital image signal DA, the latch strobe signal LS, the signal POL for controlling the polarity of a data signal, the data start pulse signal SSP, and the data clock signal SCK are input to the source driver 23, and the gate start pulse signal GSP, the gate clock signal GCK, and the gate driver output control signal GOE are input to the gate driver 22.

The source driver 23 sequentially generates, for each horizontal scanning period, data signals as analog voltages corresponding to pixel values in the horizontal scanning period of an image represented by the digital image signal DA on the basis of the digital image signal DA, the data start pulse signal SSP, the data clock signal SCK, the latch strobe signal LS, and the signal POL for controlling the polarity of a data signal (display signal voltage) and applies the data signals to the source lines Si, respectively.

The gate clock signal GCK and the gate start pulse signal GSP are input to the CS driver 24. The CS driver 24 controls the waveform of a CS voltage.

The liquid crystal display device performs multi-pixel driving as described above. That is, as shown in FIG. 13, a source signal voltage (display signal voltage) is supplied in advance from the common source line 54 to the first sub-pixel electrode 51*a* and the second sub-pixel electrode 51*b*. After the transistors 56*a* and 56*b* are turned off, the voltages on the first CS line 53*a* and the second CS line 53*b* are changed (level-shifted) so as to differ from each other. This change makes voltages applied to the first liquid crystal capacitor Clc1 and the second liquid crystal capacitor Clc2 different from each other, and a bright sub-pixel and a dark sub-pixel are formed in one pixel. In this configuration, a source signal voltage is supplied from one source line to two sub-pixel electrodes. The configuration thus has the advantage of no need to increase the number of source lines and the number of source drivers to drive the source lines.

An example in which a source line inversion driving method is applied to the liquid crystal display device will be described below.

In the liquid crystal display device, for example, a source line inversion driving method is applied to multi-pixel driving, and gate line interlaced scanning driving (interlaced driving) is performed. This configuration reduces power consumption, that is, heat generation of a source driver and allows inhibition of reduction in charging rate when an image write frequency is increased for improvement in moving image performance. Note that a method for driving the liquid crystal display device is not limited to this.

Note that an example in which odd-numbered rows are first scanned (even-numbered rows are skipped), and the even-numbered rows are then scanned will be described in a description of interlaced scanning driving. The order in interlaced scanning in the embodiment of the present invention is not limited to this. Of course, the even-numbered rows may be first scanned (the odd-numbered rows may be skipped), and the odd-numbered rows may be then scanned.

Figure 23:
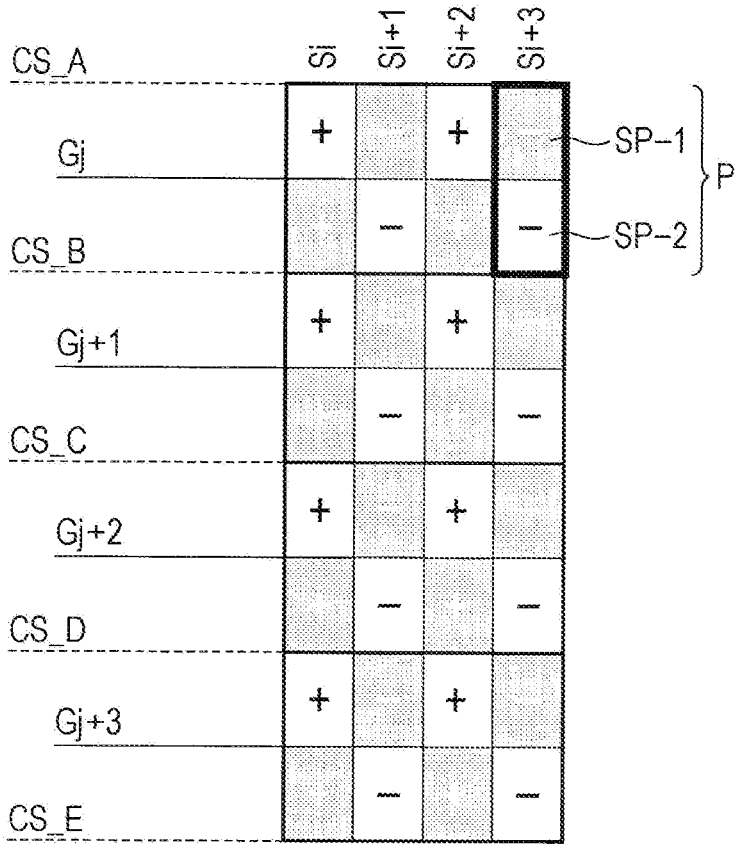
FIG. 23 is a view schematically showing the relation of connection between pixels and CS lines, the write polarity of a source signal voltage, and the layout of sub-pixels in the liquid crystal display device according to the second embodiment.

FIG. 23 is a view schematically showing the relation of connection between pixels and CS lines in the liquid crystal display device and schematically showing the write polarity (a plus or minus sign in FIG. 23) of a source signal voltage and the layout of sets of two bright and dark sub-pixels (each hatched sub-pixel in FIG. 23 is a dark sub-pixel) and shows a state in which source line inversion driving is performed. Gj to Gj+3 denote gate lines, CS_A to CS_E denote CS lines, and Si to Si+3 denote source lines. As shown in FIG. 23, in the liquid crystal display device, the write polarities for each column are the same, and bright sub-pixels and dark sub-pixels are arranged in a checkered pattern. The relation of connection between pixels showing bright sub-pixels and dark sub-pixels is as shown in FIG. 14.

Figure 24:
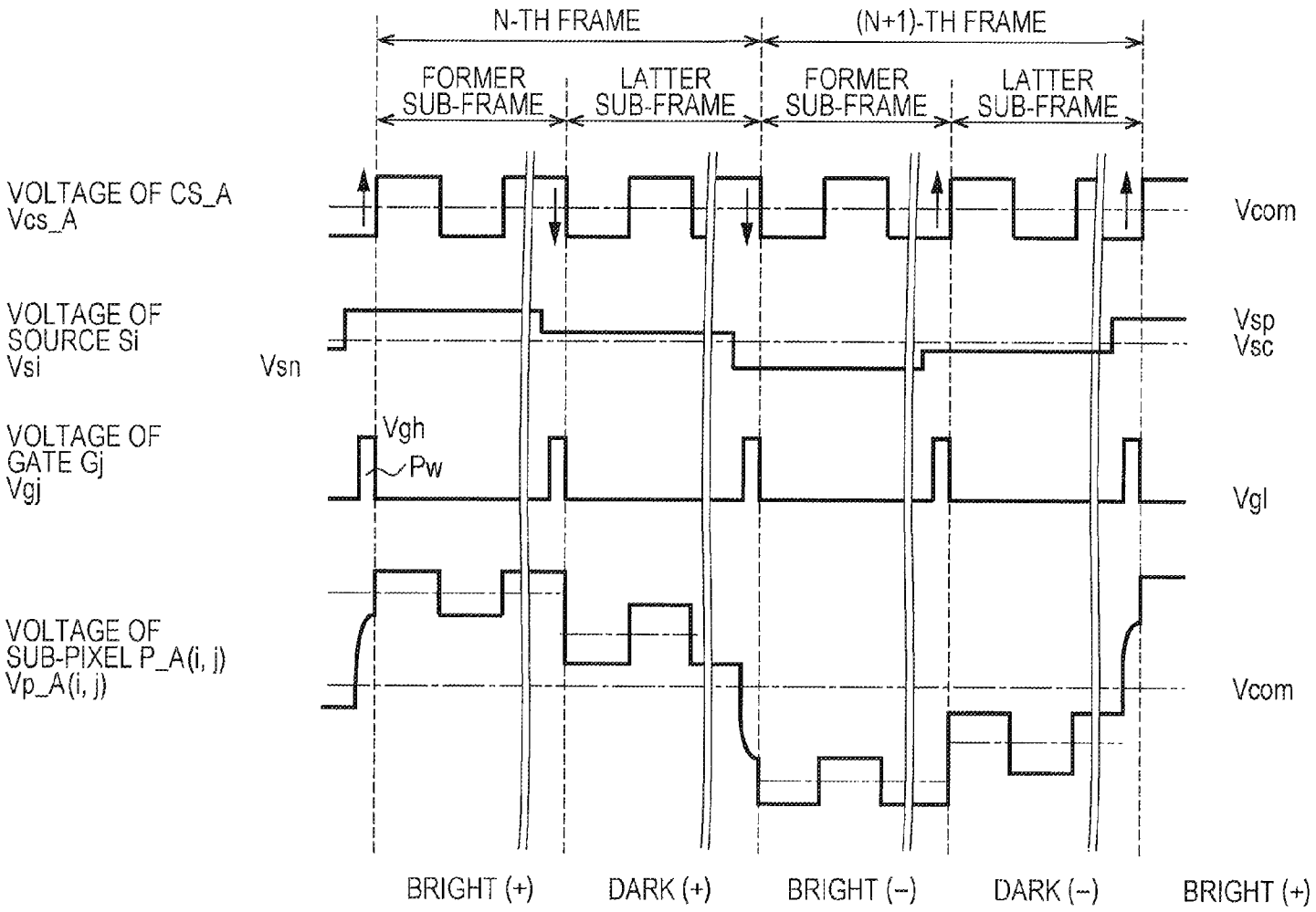
FIG. 24 is a chart showing the waveforms of individual signal voltages in two continuous frames in the liquid crystal display device according to the second embodiment.

FIG. 24 shows the waveforms of respective signal voltages in the liquid crystal display device in two continuous frames (arbitrary frames, an N-th frame and an (N+1)-th frame) and shows a CS voltage Vcs_A supplied from the CS line CS-A, a source signal voltage Vsi supplied to the i-th source line Si, a gate signal voltage Vgj supplied to the j-th gate line Gj, and a voltage Vp_A(ij) applied to a sub-pixel P_A(i,j) having a storage capacitor connected to the CS line CS-A of two sub-pixels of a pixel connected to the i-th source line Si and the j-th gate line Gj in order from top to bottom. Vcom in FIG. 24 denotes a counter voltage.

Figure 25:
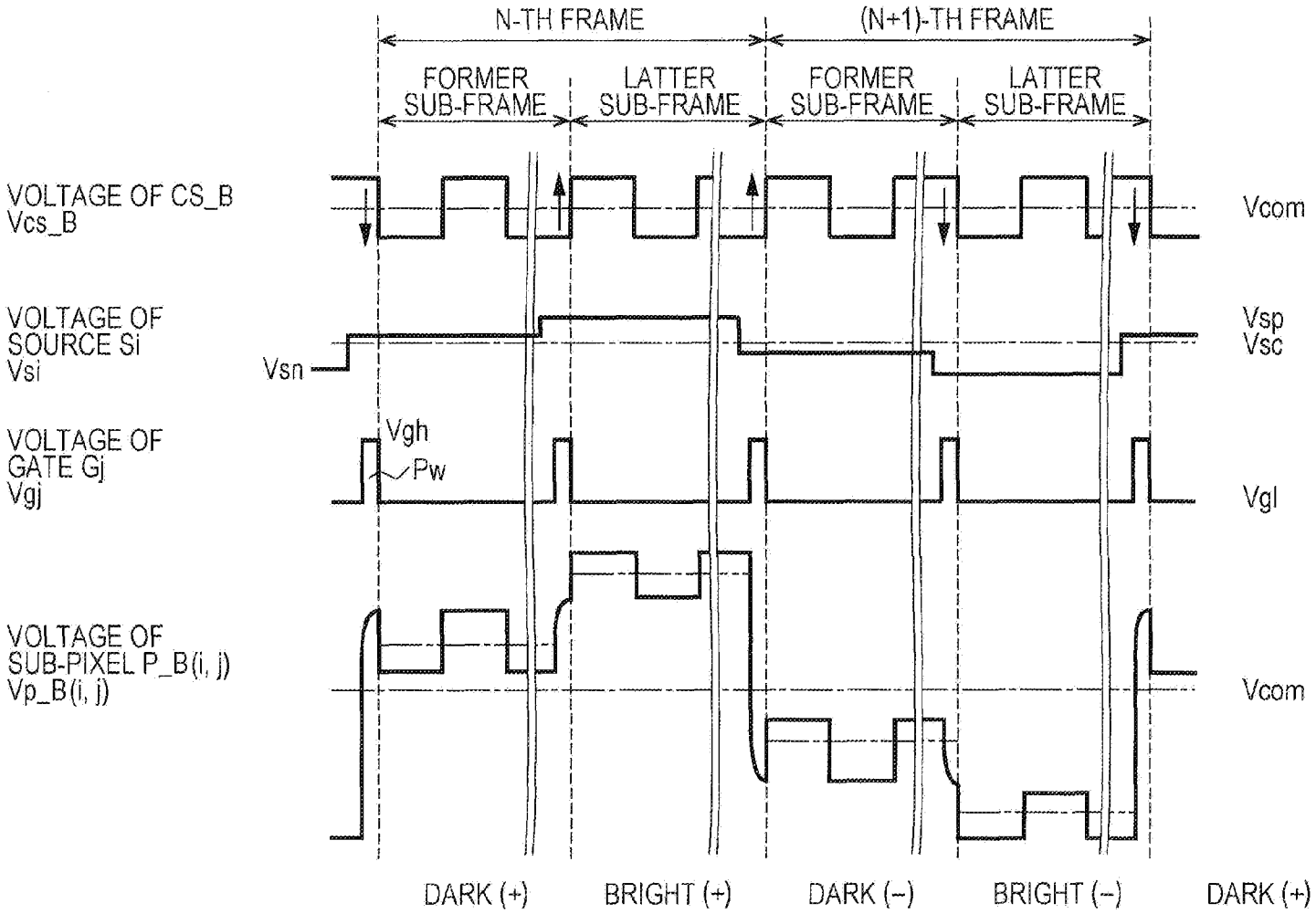
FIG. 25 is a chart showing the waveforms of individual signal voltages in an N-th frame and an (N+1)-th frame in the liquid crystal display device according to the second embodiment.

FIG. 25 shows the waveforms of respective signal voltages in the liquid crystal display device in the N-th frame and the (N+1)-th frame and shows a CS voltage Vcs_B supplied from the CS line CS_B, the source signal voltage Vsi supplied to the i-th source line Si, the gate signal voltage Vgj supplied to the j-th gate line Gj, and a voltage Vp_B(ij) applied to a sub-pixel P_B(i,j) having a storage capacitor connected to the CS line CS-B of the two sub-pixels of the pixel connected to the i-th source line Si and the j-th gate line Gj in order from top to bottom.

Figure 26:
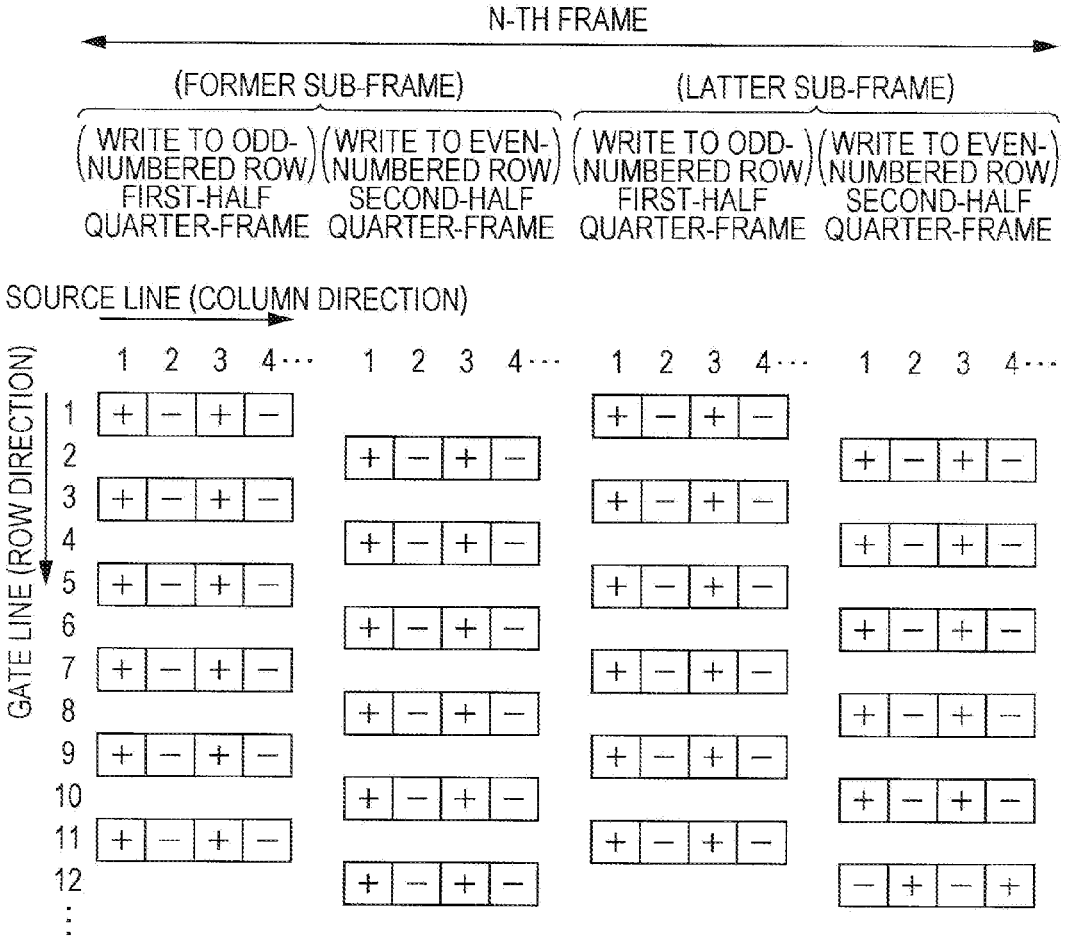
FIG. 26 is a view showing the write polarity of a source signal voltage at each pixel in one frame in the liquid crystal display device according to the second embodiment.

FIG. 26 shows the write polarities of source signal voltages at individual pixels over one frame (the given N-th frame composed of a former sub-frame and a latter-sub-frame). In the liquid crystal display device, gate line interlaced scanning driving (interlaced driving) is performed together with source line inversion driving. In FIG. 26, each sub-frame is divided into two periods (divided sub-frames; a first-half quarter-frame (first divided sub-frame period) and a second-half quarter-frame (second divided sub-frame period)).

Figure 27:
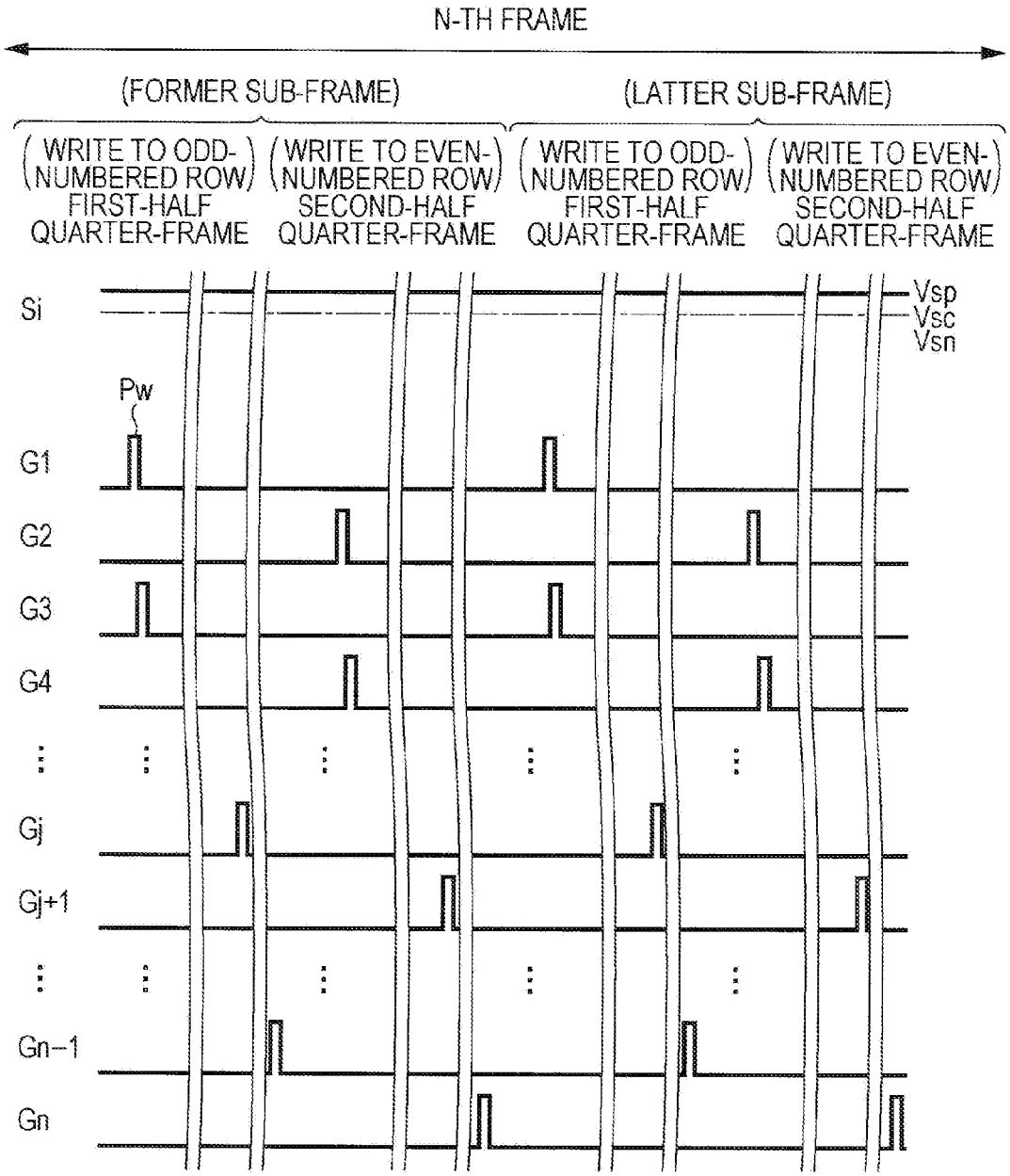
FIG. 27 is a chart for showing how pixels are scanned in the N-th frame in the liquid crystal display device according to the second embodiment.

FIG. 27 is a chart for showing how pixels are scanned in the N-th frame and schematically shows the waveforms of a source signal voltage supplied to the source line Si in an i-th column and gate signal voltages supplied to gate lines G1 to Gn in first to n-th rows. In this figure as well, each sub-frame is divided into two periods (a first-half quarter-frame and a second-half quarter-frame).

A pixel scanning method will be described with reference to FIGS. 26 and 27.

In the first-half quarter-frame of the former sub-frame in the N-th frame, for example, a pixel data write pulse Pw indicating that the gate signal voltage Vgj rises from Vgl (low level) to Vgh (high level) and remains at Vgh for a fixed period is sequentially applied to the gate lines Gj in odd-numbered rows. That is, source signal voltages are written to pixels in all odd-numbered rows from first to (n−1)-th rows.

In the second-half quarter-frame, pixels in a plurality of even-numbered rows skipped in the first-half quarter-frame are sequentially scanned. For example, the pixel data write pulse Pw indicating that Vgj rises from VgL to VgH and remains at VgH for the fixed period is sequentially applied to the gate lines Gj+1 in even-numbered rows. That is, the source signal voltages are written to pixels in all even-numbered rows from second to n-th rows.

As for the polarity of the source signal voltage supplied to the source line Si, a positive source signal voltage (Vsp) is given with respect to a source signal voltage central value Vsc (which is generally almost equal to Vcom) in the first-half quarter-frame, and a positive source signal voltage is also given in the succeeding second-half quarter-frame. A positive source signal voltage is given both in the first-half quarter-frame and the second-half quarter-frame of the latter sub-frame of the N-th frame. A negative source signal voltage (Vsn) is given with respect to Vsc in a former sub-frame of the (N+1)-th frame, and a negative source signal voltage is also given in a succeeding latter sub-frame. A source signal voltage supplied to Si+1 adjacent to the source line Si has a polarity opposite to that of the source signal voltage supplied to the source line Si. Similarly, a source signal voltage supplied to the source line Si+2 has a polarity opposite to that of the source signal voltage supplied to the source line Si+1.

The CS voltage Vcs-A supplied to the CS line CS-A has a waveform in which the polarity is inverted with respect to the counter electrode voltage Vcom at fixed intervals (for example, a rectangular wave with a duty ratio of 1:1 as illustrated).

Since the source signal voltage supplied to the source line Si when the gate signal voltage of the gate line Gj is high is positive, a positive voltage is written to the sub-pixel P-A (i,j). The CS voltage Vcs-A supplied to the CS line CS-A has a waveform in which the polarity is inverted with respect to the counter electrode voltage Vcom at the fixed intervals (for example, a rectangular wave with a duty ratio of 1:1 as illustrated), and a first change (level shift) in the CS voltage Vcs-A of the CS line CS-A after the gate signal voltage of the gate line Gj becomes low is a rise (for example, a change from negative to positive in this case). The voltage of the sub-pixel P-A(i,j) is driven up to rise, an effective voltage applied to the sub-pixel P-A(i,j) becomes not less than the source signal voltage written in response to Pw (has a larger absolute value), and the sub-pixel P-A(i,j) becomes a bright sub-pixel (see FIG. 24).

A positive voltage is also written to the sub-pixel P-B(i,j). A first change (level shift) in the CS voltage of the CS line CS-B after the gate signal voltage of the gate line Gj becomes low is a fall (for example, a change from positive to negative in this case). The voltage of the sub-pixel P-B(i,j) is driven down to fall, an effective voltage applied to the sub-pixel P-B(i,j) becomes not more than the source signal voltage written in response to Pw (has a smaller absolute value), and the sub-pixel P-B(i,j) becomes a dark sub-pixel (see FIG. 25).

As described above, the polarity of a CS voltage given to a CS line corresponding to one of two sub-pixels included in one pixel and the polarity of a CS voltage given to a CS line corresponding to the other sub-pixel are opposite to each other.

A CS voltage has a waveform in which a raising or lowering action on the effective voltage of the sub-pixel P-A(i,j) connected to the gate line Gj selected in a former sub-frame period of one frame and a raising or lowering action on the effective voltage of the sub-pixel P-A(i,j) connected to the gate line Gj selected in a latter sub-frame period are opposite to each other.

As described above, according to the liquid crystal display device and driving method, it is possible to avoid degradation in display quality, such as a non-uniform feel, without disrupting the distribution of bright pixels and dark pixels in a checkered pattern while enjoying the above-described advantage of the source line inversion driving method.

Figure 28:
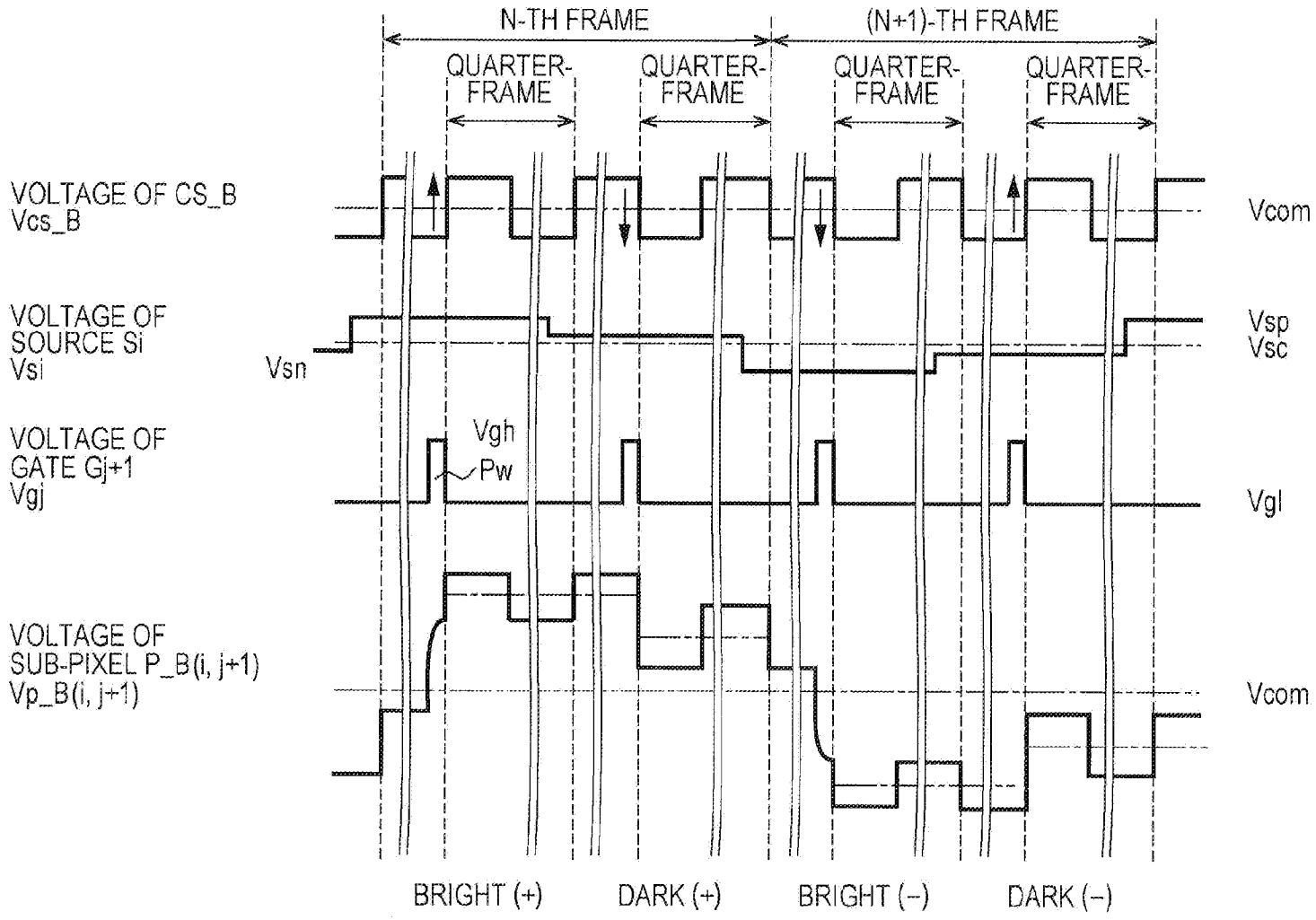
FIG. 28 is a chart showing the waveforms of signal voltages in a second-half quarter-frame in the liquid crystal display device according to the second embodiment.

FIG. 28 shows the waveforms of signal voltages in second-half quarter-frames in each (a (j+1)-th row) of a plurality of even-numbered rows skipped in first-half quarter-frames. As shown in FIG. 28, a sub-pixel P_B(i,j+1) switches in polarity and bright/dark status, like the sub-pixel P-A(i,j).

Figure 29:
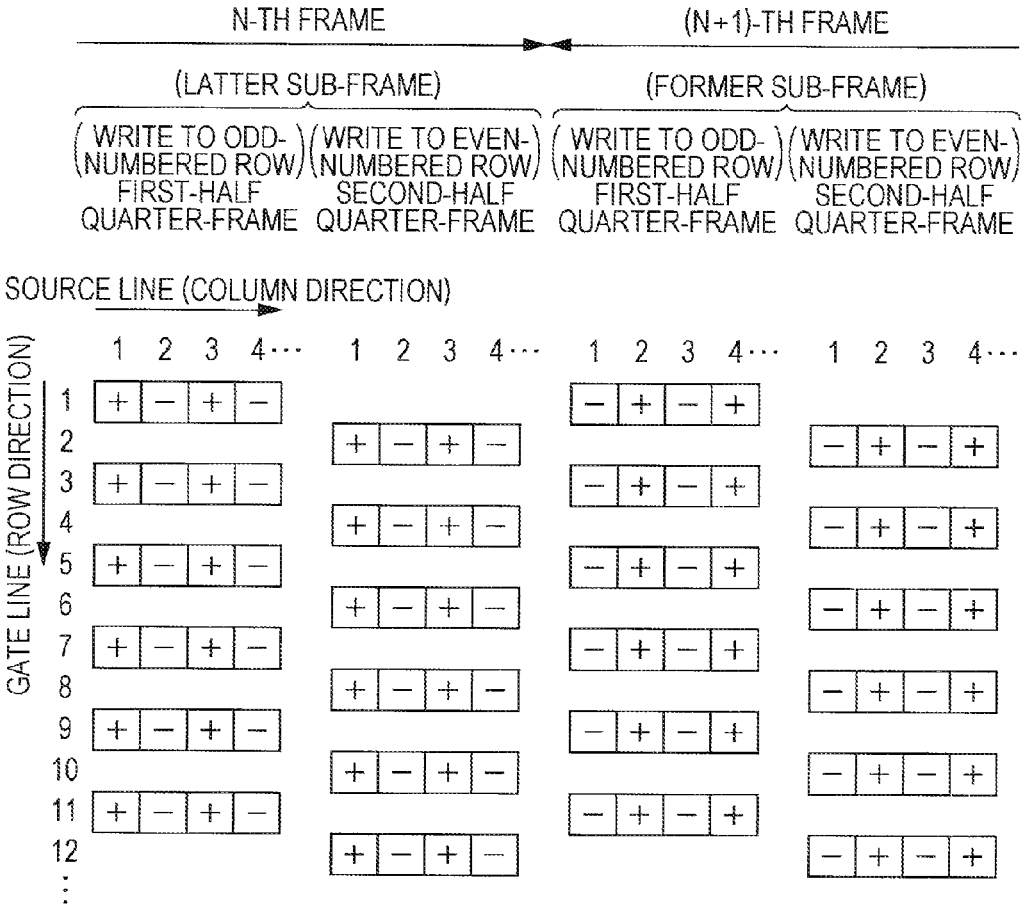
FIG. 29 is a view showing the write polarities of source signal voltages at individual pixels in a latter sub-frame of the N-th frame and a former sub-frame of the (N+1)-th frame in the liquid crystal display device according to the second embodiment.
Figure 30:
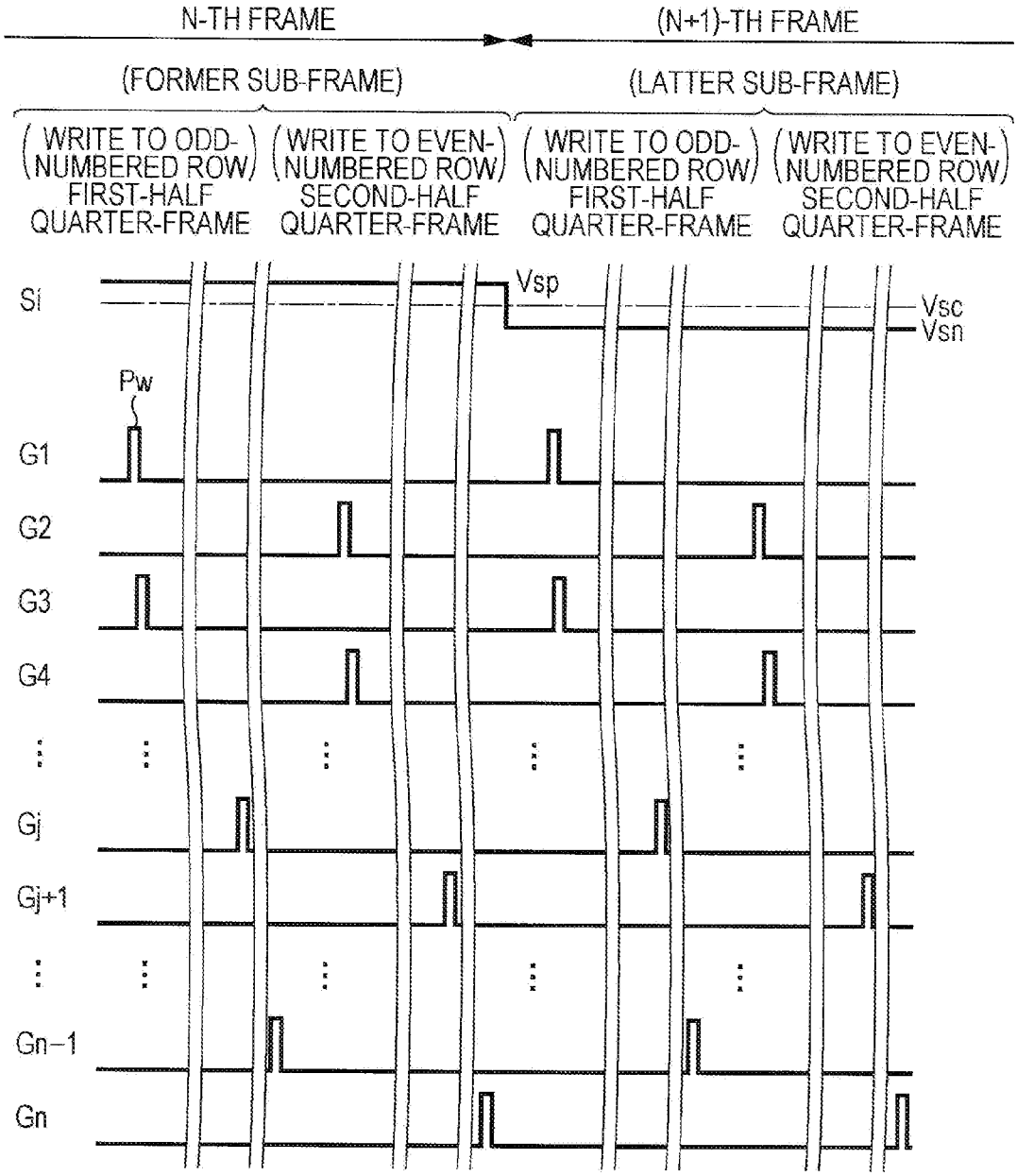
FIG. 30 is a chart for showing how pixels are scanned in the latter sub-frame of the N-th frame and the former sub-frame of the (N+1)-th frame in the liquid crystal display device according to the second embodiment.

FIG. 29 shows the write polarities of source signal voltages at individual pixels in the latter sub-frame of the N-th frame and the former sub-frame of the (N+1)-th frame. FIG. 30 is a chart for showing how pixels are scanned in the latter sub-frame of the N-th frame and the former sub-frame of the (N+1)-th frame and schematically shows the waveforms of the source signal voltage supplied to the source line Si in the i-th column and the gate signal voltages supplied to the gate lines G1 to Gn in the first to n-th rows. As described above, the polarity of each source signal voltage is inverted every frame cycle (every cycle of duration equal to that of one frame).

As described above, the liquid crystal display device performs frame division driving and pixel division driving. Thus, sub-pixels are arranged in a checkered pattern, and the bright/dark status of each sub-pixel switches from one to the other every sub-frame (see FIG. 33). In the liquid crystal display device with the above-described configuration, sub-frames are different from each other in a source signal voltage to be written to each sub-pixel.

Display Example

An example in which a linear image is displayed in the row direction in the liquid crystal display device is as shown in FIGS. 9 and 10. As can be seen from this, a linear image can be displayed using a plurality of sub-pixels SP1 arranged in the row direction. That is, sub-pixels in one pixel can be independently controlled in luminance. An input signal having a longitudinal resolution twice the longitudinal resolution of the display panel can thus be displayed.

As described above, in the liquid crystal display device according to the present embodiment as well, display quality with a longitudinal resolution (vertical resolution) twice that of a conventional liquid crystal display device can be achieved. In, for example, a FHD (1920 wide by 1080 high) liquid crystal panel, a high-resolution image (1920 wide by 2160 high) can be displayed.

(Modification)

The liquid crystal display devices according to the first and second embodiments can be applied to, for example, the multiple primary color display device described in "WO 2011/102343".

That is, in a liquid crystal display device, one display pixel may be composed of three types of sub-pixels, red, green, and blue sub-pixels, or four or more types of sub-pixels. As an example, a liquid crystal display device with one display pixel composed of four types of sub-pixels, red, green, blue, and yellow sub-pixels, will be described below.

Figure 31:
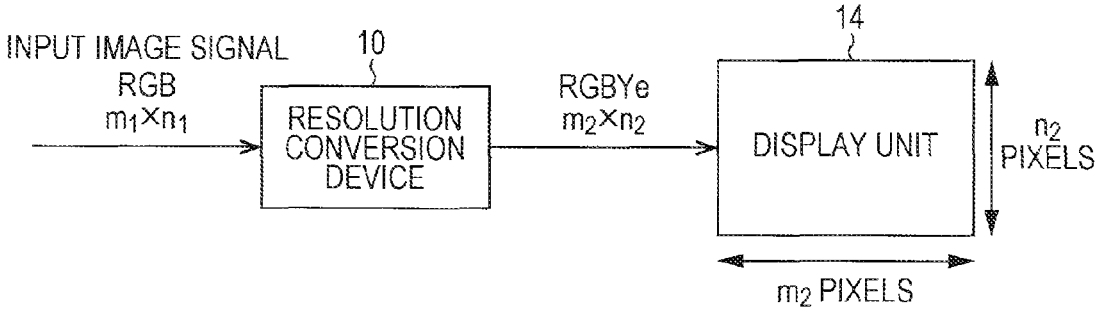
FIG. 31 is a diagram showing the schematic configuration of a liquid crystal display device according to a modification.

FIG. 31 shows a liquid crystal display device according to a modification. As shown in FIG. 31, the liquid crystal display device is a multiple primary color display device which includes a resolution conversion device 10 (corresponding to the control unit 15 in FIG. 12) and the display unit 14 and produces a display using four primary colors.

Figure 32:
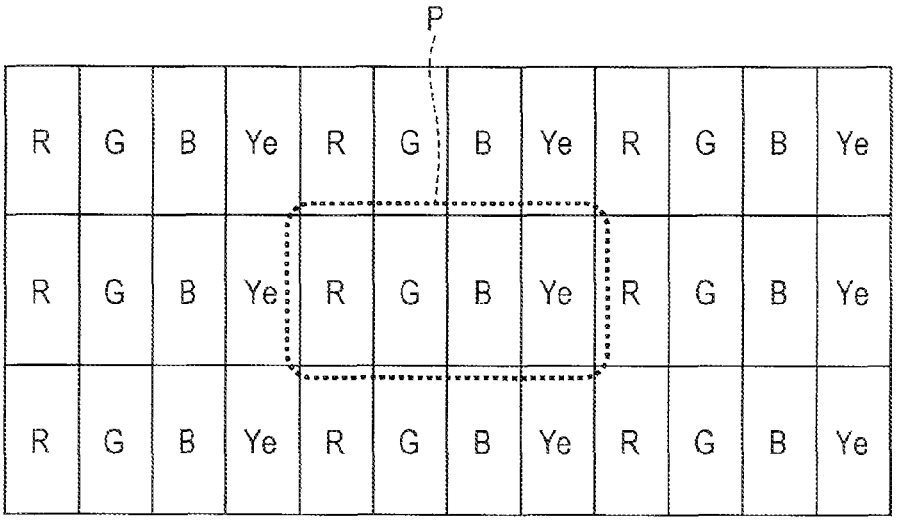
FIG. 32 is a view showing the specific pixel structure of a liquid crystal panel in a display unit of the liquid crystal display device according to the modification.

FIG. 32 shows a specific pixel structure (the layout of sub-pixels) of the liquid crystal panel 21 in the display unit 14. As shown in FIG. 32, a plurality of pixels P are each composed of four types of sub-pixels which display colors different from each other. Specifically, the four types of sub-pixels are a red sub-pixel R which displays red, a green sub-pixel G which displays green, a blue sub-pixel B which displays blue, and a yellow sub-pixel Ye which displays yellow. In each pixel P, these four types of sub-pixels are arranged in one row by four columns. Each of the four types of sub-pixels is composed of a bright sub-pixel or a dark sub-pixel.

In the following description, unless otherwise specified, the total number of the plurality of pixels P of the liquid crystal panel is referred to as a "display resolution". The display resolution when the plurality of pixels P are arranged in m pixels in a row direction by n pixels in a column direction is expressed as "m×n". A minimum display unit of an input image is also referred to as a "pixel", and the total number of pixels of an input image is referred to as the "resolution of the input image". In this case as well, the resolution of an input image composed of m pixels in the row direction and n pixels in the column direction is expressed as "m×n".

The resolution conversion device 10 shown in FIG. 31 converts the resolution ($m_1 \times n_1$) of an image signal input from the outside such that the resolution coincides with the display resolution ($m_2 \times n_2$) of the display unit 14. The resolution conversion device 10 also converts an image signal corresponding to three primary colors (red, green, and blue) into a multiple primary color signal corresponding to four primary colors (red, green, blue, and yellow displayed by the red sub-pixel R, the green sub-pixel G, the blue sub-pixel B, and the yellow sub-pixel Ye).

In the liquid crystal display device, the four types of sub-pixels are arranged in each of the plurality of pixels P such that a sub-pixel which displays a color having the highest luminance among the four types of sub-pixels (referred to as a "first sub-pixel" for the sake of convenience) and a sub-pixel which displays a color having the second highest luminance (referred to as a "second sub-pixel" for the sake of convenience) are not adjacent to each other (namely, such that the sub-pixels have at least one sub-pixel located therebetween). FIG. 32 shows an example of the layout of sub-pixels when the first sub-pixel is the green sub-pixel G and the second sub-pixel is the yellow sub-pixel Ye. In the example shown in FIG. 32, in each pixel P, the four types of sub-pixels are located in the order of the red sub-pixel R, the green sub-pixel G, the blue sub-pixel B, and the yellow sub-pixel Ye from left to right. The green sub-pixel G and the yellow sub-pixel Ye are not adjacent to each other.

In the liquid crystal display device, if the resolution of an input image is higher than the display resolution (that is, if the total number of pixels of the input image is larger than the total number of the plurality of pixels P of the liquid crystal panel), each of the plurality of display units can be used as a virtual pixel to produce a display. Thus, the visual resolution in a horizontal direction can be improved. In the liquid crystal display device, the first sub-pixel that displays a color having the highest luminance (that is, having the highest luminance at a maximum grayscale level) and the second sub-pixel that displays a color having the second highest luminance (that is, having the second highest luminance at the maximum grayscale level) are arranged so as not to be adjacent to each other in the pixel P. The spatial frequency of luminance distribution can be made higher than that when the first sub-pixel and the second sub-pixel are arranged adjacent to each other. Thus, visual recognition of two adjacent virtual pixels as being merged can be avoided.

Figure 33:
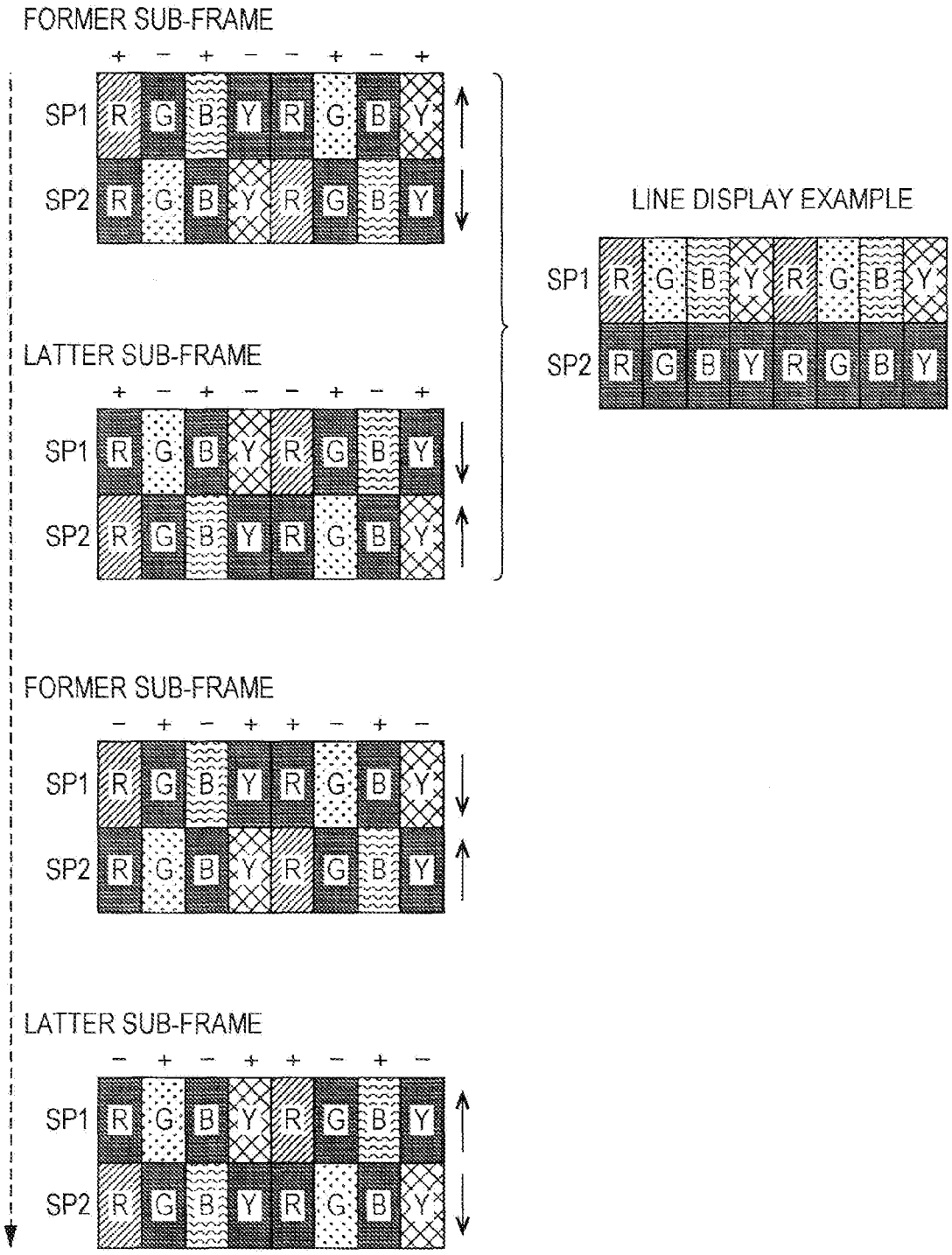
FIG. 33 is a view schematically showing the states of change between bright and dark at individual sub-pixels for every sub-frame in two continuous frames in the liquid crystal display device according to the modification.

The liquid crystal display device performs the frame division driving and the pixel division driving illustrated in the first or second embodiment. FIG. 33 schematically shows the states of change between bright and dark at individual sub-pixels for every sub-frame in two continuous frames. Note that, in FIG. 33, positive polarities and negative polarities indicate the polarities of signal voltages supplied to respective source lines and the up and down arrows each indicate how a CS voltage changes after a corresponding gate signal voltage becomes low. Gray color in FIG. 33 indicates a dark sub-pixel.

In the liquid crystal display device according to the present modification, sub-pixels in one pixel can be independently controlled in luminance. The liquid crystal display device according to the present modification can achieve display quality corresponding to a twofold longitudinal resolution (vertical resolution) and a twofold lateral resolution (horizontal resolution). This allows display of an image (3840 wide by 2160 high) corresponding to a 4K2K panel (ultra-high definition panel) in, for example, a FHD (1920 wide by 1080 high) liquid crystal panel.

(Concerning CS Voltage)

The amplitude of a CS voltage is generally determined such that lighting of a dark sub-pixel is started before a bright sub-pixel becomes brightest, to achieve a wide viewing angle. In the liquid crystal display device according to the first or second embodiment, a CS voltage is preferably adjusted so as to have an appropriate amplitude, to obtain a maximum effect of high resolution. Specifically, the amplitude of a CS voltage is determined such that a dark sub-pixel lights up after a bright sub-pixel reaches a maximum value.

FIG. 34 are graphs showing the relation between a grayscale level and the transmittance of each sub-pixel (SP1 or SP2) depending on a CS voltage. It can be seen from the graphs that a dark sub-pixel starts to light up before a bright sub-pixel becomes completely white near a grayscale level of 160 for a CS voltage for a wider viewing angle (graphs denoted by A0) (see FIGS. 34(*a*) and (*b*)).

In contrast, for a CS voltage of the present liquid crystal display device for a higher resolution (graphs denoted by A1), the amplitude of the CS voltage is preferably set such that a bright sub-pixel becomes a maximum and a dark sub-pixel becomes a minimum when a grayscale level value (a grayscale level of 186 derived from Equation (2)) at which a luminance of 0.5 is obtained is input (see FIGS. 34(*a*) and (*c*)).

The present invention is not limited to the above-described embodiments and can be changed in various manners within the scope of the claims. That is, other embodiments obtained by combining technical means appropriately changed within the scope of the claims are also included in the technical scope of the present invention.

INDUSTRIAL APPLICABILITY

The present invention can be preferably applied to various types of electronic equipment, such as a liquid crystal television.

REFERENCE SIGNS LIST

10 resolution conversion device
11 frame memory (FM)
12 former-stage LUT
13 latter-stage LUT
14 display unit
15 control unit
21 liquid crystal panel
22 gate driver (scanning signal line drive circuit)
23 source driver (data signal line drive circuit)
24 CS driver (storage capacitor line drive circuit)
P pixel
SP sub-pixel
SP1 first sub-pixel
SP2 second sub-pixel

The invention claimed is:

1. A display device for displaying an image with each frame divided into two sub-frames including a first sub-frame and a second sub-frame, the display device comprising:

a plurality of pixels arranged in display units, each of the display units having a first sub-pixel and a second sub-pixel different in luminance from each other, the first sub-pixel and the second sub-pixel are each arranged in a row direction and are alternately arranged in a column direction, the first sub-pixel and the second sub-pixel being connected to a single data signal line and a single scanning signal line and are connected to storage capacitor lines different from each other, the display device configured to display an image corresponding to an input signal inputted thereto from an outside by making the two sub-frames different from each other in a voltage to be supplied to each pixel;

a control unit which outputs a display signal in the first sub-frame and a display signal in the second sub-frame to a corresponding one of the display units such that the control unit produces a luminance difference between the first sub-pixel and the second sub-pixel in each pixel of the plurality of pixels and inverts a magnitude relation in luminance between the first sub-pixel and the second sub-pixel in each pixel of the plurality of pixels in each of the two sub-frames by level-shifting a storage capacitor line signal which is supplied to a storage capacitor line corresponding to the first sub-pixel and a storage capacitor line signal which is supplied to a storage capacitor line corresponding to the second sub-pixel in directions different from each other and changing a level-shift direction for each storage capacitor line signal within the frame, and inverting a voltage polarity of a display signal every frame cycle and making the two sub-frames different from each other in a voltage of the display signal, in a first case where in one pixel of the plurality of pixels, (i) luminance of a first sub-pixel of the one pixel is equal to or greater than luminance of a second sub-pixel of the one pixel in the first sub-frame and (ii) the luminance of the first sub-pixel of the one pixel is equal to or lower than the luminance of the second sub-pixel of the one pixel in the second sub-frame, the control unit causes the first sub-pixel of the one pixel to be lighted only in the first sub-frame, if the luminance of the second sub-pixel of the one pixel indicated by the input signal is 0 and when a grayscale level of the first sub-pixel of the one pixel is between not lower than one at which luminance of the first sub-pixel of the one pixel indicated by the input signal is minimum and lower than one at which luminance is 0.5, and the control unit causes the second sub-pixel of the one pixel to be lighted only in the second sub-frame, if the luminance of the first sub-pixel of the one pixel indicated by the input signal is 0 and when a grayscale level of the second sub-pixel of the one pixel is between not lower than one at which the luminance of the second sub-pixel of the one pixel indicated by the input signal is minimum and lower than one at which luminance is 0.5, in a second case where in another pixel of the plurality of pixels, (iii) luminance of a first sub-pixel of the another pixel is equal to or lower than luminance of a second sub-pixel of the another pixel in the first sub-frame and (iv) the luminance of the first sub-pixel of the another pixel is equal to or greater than the luminance of the second sub-pixel of the another pixel in the second sub-frame, the control unit causes the first sub-pixel of the another pixel to be lighted only in the second sub-frame, if the luminance of the second sub-pixel of the another pixel indicated by the input signal is 0 and when a grayscale level of the first sub-pixel of the another pixel is between not lower than one at which the luminance of the first sub-pixel of the another pixel indicated by the input signal is minimum and lower than one at which luminance is 0.5.

2. The display device according to claim 1, wherein the two sub-frames within the frame are different from each other in the level-shift direction for the storage capacitor line signal given to each of the storage capacitor lines, and a last one of the two sub-frames of the frame and a first one of the two sub-frames of a succeeding frame are equal to each other in the level-shift direction for the storage capacitor line signal given to the storage capacitor line.

3. The display device according to claim 1, wherein if the display unit displays a grayscale level of 0 to a grayscale level of 255, a grayscale level, at which luminance is 0.5, is a grayscale level of 186.

4. The display device according to claim 1, wherein the storage capacitor line signal given to each storage capacitor line of the storage capacitor lines is not level-shifted during writing of a signal voltage to a pixel electrode which, together with a storage capacitor line, forms a capacitor and is level-shifted in a positive direction or a negative direction with respect to a reference voltage in synchronization with or after an end of the writing.

5. The display device according to claim 4, wherein one storage capacitor line of the storage capacitor lines which, together with one pixel electrode of two pixel electrodes included in each pixel, forms a first capacitor and another storage capacitor line of the storage capacitor lines which, together with another pixel electrode of the two pixel electrodes included in each pixel, forms a second capacitor, the first capacitor and the second capacitor are opposite to each other in storage capacitor line signal level-shift direction.

6. The display device according to claim 4, wherein one pixel electrode included in a first pixel of two pixels adjacent in a scanning direction form a first capacitor together with a single storage capacitor line of the storage capacitor lines and one pixel electrode included in a second pixel of the two pixels adjacent in the scanning direction form a second capacitor together with the single storage capacitor line.

7. The display device according to claim 1, wherein each pixel of the plurality of pixels is composed of four types of color pixels displaying colors different from each other, and each of the four types of color pixels includes the first sub-pixel and the second sub-pixel.

8. The display device according to claim 7, wherein the four types of color pixels are a red pixel displaying red, a green pixel displaying green, a blue pixel displaying blue, and a yellow pixel displaying yellow, and the color pixels in this order are repeatedly arranged in a row direction.

9. The display device according to claim 1, wherein in the first case, when the luminance of the second sub-pixel of the one pixel indicated by the input signal is 1 and when a grayscale level of the first sub-pixel of the one pixel is between not lower than one at which the luminance of the first sub-pixel of the one pixel indicated by the input signal is 0.5 and lower than one at which luminance is 1, in the first sub-frame, the control unit causes the first sub-pixel of the one pixel and the second sub-pixel of the one pixel to be lighted so that the luminance of the first sub-pixel of the one pixel and the luminance of the second sub-pixel of the one pixel are each 1, and in the second sub-frame, the control unit sets the luminance of the first sub-pixel of the one pixel in accordance with the luminance of the first sub-pixel of the one pixel indicated by the input signal and causes the second sub-pixel of the one pixel to be lighted so that the luminance of the second sub-pixel of the one pixel is 1, in the first case, when the luminance of the first sub-pixel of the one pixel indicated by the input signal is 1 and when a grayscale level of the second sub-pixel of the one pixel is between not lower than one at which the luminance of the second sub-pixel of the one pixel indicated by the input signal is 0.5 and lower than one at which luminance is 1, in the first sub-frame, the control unit sets the luminance of the second sub-pixel of the one pixel in accordance with the luminance of the second sub-pixel of the one pixel indicated by the input signal and causes the first sub-pixel of the one pixel to be lighted so that the luminance of the first sub-pixel of the one pixel is 1, and in the second sub-frame, the control unit causes the first sub-pixel of the one pixel and the second sub-pixel of the one pixel to be lighted so that the luminance of the first sub-pixel of the one pixel and the luminance of the second sub-pixel of the one pixel are each 1.

10. A display method for a display device for displaying an image with each frame divided into two sub-frames including a first sub-frame and a second sub-frame, the display device including a plurality of pixels arranged in display units, each of the display units having a first sub-pixel and a second sub-pixel different in luminance from each other, the first sub-pixel and the second sub-pixel are each arranged in a row direction and alternately arranged in a column direction, the display device configured to display an image corresponding to an input signal inputted thereto from an outside by making the two sub-frames different from each other in a voltage to be supplied to each pixel, the display method comprising:

outputting a display signal in the first sub-frame and a display signal in the second sub-frame to a corresponding one of the display units such that a luminance difference is produced between the first sub-pixel and the second sub-pixel in each pixel of the plurality of pixels and a magnitude relation in luminance between the first sub-pixel and the second sub-pixel in each pixel of the plurality of pixels is inverted in each of the two sub-frames by level-shifting a storage capacitor line signal which is supplied to a storage capacitor line corresponding to the first sub-pixel and a storage capacitor line signal which is supplied to a storage capacitor line corresponding to the second sub-pixel in directions different from each other and changing a level-shift direction for each storage capacitor line signal within the frame, and inverting a voltage polarity of a display signal every frame cycle and making the two sub-frames different from each other in a voltage of the display signal, wherein in a first case where in one pixel of the plurality of pixels, (i) luminance of a first sub-pixel of the one pixel is equal to or greater than luminance of a second sub-pixel of the one pixel in the first sub-frame and (ii) the luminance of the first sub-pixel of the one pixel is equal to or lower than the luminance of the second sub-pixel of the one pixel in the second sub-frame, causing the first sub-pixel of the one pixel to be lighted only in the first sub-frame, if the luminance of the second sub-pixel of the one pixel indicated by the input signal is 0 and when a grayscale level of the first sub-pixel of the one pixel is between not lower than one at which the luminance of the first sub-pixel of the one pixel indicated by the input signal is minimum and lower than one at which luminance is 0.5, and causing the second sub-pixel of the one pixel to be lighted only in the second sub-frame, if the luminance of the first sub-pixel of the one pixel indicated by the input signal is 0 and when a grayscale level of the second sub-pixel of the one pixel is between not lower than one at which the luminance of the second sub-pixel of the one pixel indicated by the input signal is minimum and lower than one at which luminance is 0.5, in a second case where in another pixel of the plurality of pixels, (iii) luminance of a first sub-pixel of the another pixel is equal to or lower than luminance of a second sub-pixel of the another pixel in the first sub-frame and (iv) the luminance of the first sub-pixel of the another pixel is equal to or greater than the luminance of the second sub-pixel of the another pixel in the second sub-frame, causing the first sub-pixel of the another pixel to be lighted only in the second sub-frame, if the luminance of the second sub-pixel of the another pixel indicated by the input signal is 0 and when a grayscale level of the first sub-pixel of the another pixel is between not lower than one at which the luminance of the first sub-pixel of the another pixel indicated by the input signal is minimum and lower than one at which luminance is 0.5.

* * * * *